US011075491B2

(12) United States Patent
Hsu et al.

(10) Patent No.: US 11,075,491 B2
(45) Date of Patent: Jul. 27, 2021

(54) COAXIAL CABLE CONNECTOR AND UNIVERSAL COAXIAL CABLE FIXING SLEEVE THEREOF

(71) Applicant: EZCONN CORPORATION, Taipei (TW)

(72) Inventors: Yu Hong Hsu, New Taipei (TW); Kai Chih Wei, Taipei (TW)

(73) Assignee: EZconn Corporation, Taipei (TW)

( * ) Notice: Subject to any disclaimer, the term of this patent is extended or adjusted under 35 U.S.C. 154(b) by 0 days.

(21) Appl. No.: 16/740,534

(22) Filed: Jan. 13, 2020

(65) Prior Publication Data

US 2020/0227875 A1 Jul. 16, 2020

Related U.S. Application Data

(60) Provisional application No. 62/792,436, filed on Jan. 15, 2019.

(51) Int. Cl.

| | |
|---|---|
| ***H01R 31/06*** | (2006.01) |
| ***H01R 13/62*** | (2006.01) |
| ***H01R 13/506*** | (2006.01) |
| ***H01R 13/52*** | (2006.01) |
| *H01R 13/622* | (2006.01) |

(Continued)

(52) U.S. Cl.

CPC ..... *H01R 31/06* (2013.01); *H01R 13/506* (2013.01); *H01R 13/5205* (2013.01); *H01R 13/62* (2013.01); *H01R 9/0521* (2013.01); *H01R 9/0524* (2013.01); *H01R 9/0527* (2013.01); *H01R 13/582* (2013.01); *H01R 13/585* (2013.01); *H01R 13/622* (2013.01); *H01R 13/6592* (2013.01); *H01R 24/38* (2013.01); *H01R 24/40* (2013.01); *H01R 24/56* (2013.01); *H01R 24/564* (2013.01);

(Continued)

(58) Field of Classification Search

CPC .. H01R 2103/00; H01R 24/40; H01R 9/0521; H01R 9/0524; H01R 9/0518; H01R 9/05; H01R 13/622; H01R 24/564; H01R 24/38; H01R 13/6592; H01R 24/56; H01R 2201/18; H01R 2201/24; H01R 31/06; H01R 13/62; H01R 13/506; H01R 13/5205; H01R 13/585; H01R 13/582; H01R 9/0527

USPC ..... 439/578, 583–585

See application file for complete search history.

(56) References Cited

U.S. PATENT DOCUMENTS 6,773,303 B1 * 8/2004 Lin ..... H01R 9/0521 439/578

* cited by examiner

*Primary Examiner* — Abdullah A Riyami
*Assistant Examiner* — Justin M Kratt

(57) ABSTRACT

A coaxial cable connector system, comprising a coaxial connector, a coaxial cable, and a universal coaxial cable fixing sleeve is provided. The universal coaxial cable fixing sleeve comprises a first gripping component, a second gripping component, and a third gripping component. When the coaxial cable is assembled to the universal coaxial cable fixing sleeve, the first gripping component grips a conductive shield of the cable, and the second and third gripping components grip a protective outer jacket of the cable, respectively. When the universal coaxial cable fixing sleeve is engaged to a first connector, a first housing outer surface thereof corresponds to and fixedly engages with a sleeve receiving inner surface of the first connector, and when disengaged and engaged to a second connector different in type from the first connector, no re-preparation of the cable is required for corresponding fixed engagement.

20 Claims, 13 Drawing Sheets

(51) Int. Cl.

| | |
|---|---|
| *H01R 9/05* | (2006.01) |
| *H01R 103/00* | (2006.01) |
| *H01R 13/585* | (2006.01) |
| *H01R 24/38* | (2011.01) |
| *H01R 13/6592* | (2011.01) |
| *H01R 24/56* | (2011.01) |
| *H01R 24/40* | (2011.01) |
| *H01R 13/58* | (2006.01) |

(52) U.S. Cl.
CPC ..... *H01R 2103/00* (2013.01); *H01R 2201/18* (2013.01); *H01R 2201/24* (2013.01)

COAXIAL CABLE CONNECTOR AND UNIVERSAL COAXIAL CABLE FIXING SLEEVE THEREOF

RELATED APPLICATIONS

This application is a non-provisional of, claims the benefit and priority of, U.S. provisional Appln No. 62/792,436, filed Jan. 15, 2019, which is incorporated herein by reference in its entirety.

TECHNICAL FIELD

Example embodiments relate generally to the field of data communications and, more particularly, to coaxial cable connectors and coaxial cable fixing sleeves thereof.

BACKGROUND

Driven by the ever-growing computing demands of cloud users, generation of massive amounts of data by edge computing devices such as AI-enabled IoT devices, and roll-out of 5G networks, the architectures of hyperscale, colocation and on-premise data centers have been forced to rapidly evolve. Also, new data centers closer to end-users or devices are being built as the demand for services that rely on edge data centers increase.

For data centers, whether it is new builds or network upgrades, proper cabling infrastructure is required for successful application delivery within the data centers. The cabling infrastructure must be reliable, easy to install, modular and flexible, to accommodate changes, and scalable to support data center growth. In general, the cabling infrastructure connects the end and intermediate points of traffic patterns within the data centers to and from routers, interconnection switches, access switches, servers, SAN switches and storage. Of the types of cabling employed in data centers, coaxial cables continue to play an important role in different parts of the network infrastructure, such as short reach connections at the server, switch and top or rack layers.

Generally, for installation of coaxial cables in data centers, termination points and cable types, routing, and cable lengths are determined before the cables are routed, formed, dressed and terminated with the proper connector for the corresponding cable type and then connected. The coaxial cable connectors mechanically couple and align a metal center pin/cable conductor wire of a jack connector with a center hole of a plug connector and allow for reliable and accurate transmission of data, video and voice communications via the attached cable. Cable termination is the connection of the wire to a device, such as equipment, blocks, panels or a wall outlet via the coaxial cable connector, which allows connection of the cable to other cables or devices.

As an example, the coaxial cable connectors comprise of a nut having an annular collar, accommodating a coaxial cable attached to the nut by crimping, soldering or welding, compression and/or twist-on methods, an annular nut, rotatably coupled to the collar, mechanically fixing the coaxial cable connector to an external cable or device, and an annular post, interposed between the collar and the nut. There are a variety of connector types, such as Bayonet Neil-Concelman (BNC), The Threaded Neill-Concelman (TNC), SubMiniature version A (SMA), N-Type, F-Type, and Micro coaxial (MCX) and The Radio Corporation of America (RCA) connectors, with various coupling techniques such as threaded, twist or bayonet locks, or snap-on, and more than one type of connector may be attached to a same cable type. For example, a TNC or N-Type connector may be attached to an RG58 cable and a TNC, SMA or MCX connector may be attached to an RG174 cable.

A coaxial cable comprises of a center conductor, surrounded by an insulator (dielectric), which is covered by at least a conductive shield and usually, a protective outer jacket. Constant spacing is controlled throughout the cable for data transmission without interference or damage from the environment; especially between the center conductor and outer conductive shield.

With new data centers being built and existing data centers being upgraded the problem of poor cable termination and/or inadequate minimum straight lengths at each finished cable end during installation have increased. Often, there are multiple cables and cable segments connected in a data center, with the coaxial cable connector or connector interface type used changing not just once, but, several times during deployment. When changing of the coaxial cable connector or connector interface type is required, often, the coaxial cable connectors are re-terminated. However, this manual procedure is time-consuming, increases the risk of human error, and often, requires special tools for completion. A poor re-termination, for example, between a connector type and cable due to human error such as poor crimping, may result in uneven impedance matching, signal degradation, damaged equipment or devices, or signals not being transmitted. Also, multiple changing of connectors and connector types, require installers to further manipulate the installed and surrounding cables, increasing the risks of inadequate minimum straight lengths at each finished cable, negatively affecting proper clearance and strain relief.

SUMMARY

Coaxial cable connectors, coaxial cable systems, and universal coaxial cable fixing sleeves are provided.

In an embodiment, a coaxial cable connector system comprising a coaxial connector, a coaxial cable, and a universal coaxial cable fixing sleeve is provided. The coaxial connector comprises a nut, defining an interior channel therethrough, comprising a mating end portion and a fixing sleeve receiving portion. The mating end portion is configured to couple with a mating connector. The fixing sleeve receiving portion includes a distal fixing sleeve receiving end and a fixing sleeve receiving inner surface having a fixing sleeve receiving stop wall. The coaxial cable has a center conductor, surrounded by a dielectric core, which is covered by at least a conductive shield and a protective outer jacket.

The universal coaxial cable fixing sleeve comprises a housing, a receiving sleeve, a first gripping component, a second gripping component, a deflecting ring, and a third gripping component. The housing, defining an interior channel therethrough, comprises a first housing portion including a first housing inner surface, a second housing portion having a second housing outer surface and a second housing stop wall between the first housing portion and second housing outer surface, and a housing distal end. The receiving sleeve, defining an interior channel therethrough, includes a proximal sleeve end, a first sleeve portion and a second sleeve portion. The first sleeve portion has a first sleeve inner surface, a central sleeve inner surface, and a central sleeve stop wall. The second sleeve portion has a second sleeve inner surface and a second sleeve ledge at a distal end thereof. The central sleeve stop wall is between the proximal sleeve end and second sleeve ledge, whereby when assembled, the proximal sleeve end and first sleeve inner surface rests flush against the second housing stop wall and the second housing outer surface, respectively.

The first gripping component is fixedly attached to the first housing inner surface and the second gripping component has one end fixedly attached to the housing distal end. The deflecting ring has a ring inner ramp positioned flush against the second gripping component, a ring outer surface fixedly attached to the central sleeve inner surface, and a ring distal inner groove opposite the ring inner ramp. The third gripping component is fixedly attached within the ring distal inner groove, second sleeve inner surface, and second sleeve ledge.

When the coaxial cable is assembled to the universal coaxial cable fixing sleeve, the first gripping component grips a conductive shield of the cable, and the second and third gripping components grip a protective outer jacket of the cable, respectively. The individual gripping of the conductive shield and protective outer jacket are each, positioned in at least three concentric and evenly separated positions and when the universal coaxial cable fixing sleeve is assembled to the coaxial connector, the first housing portion is fixedly engaged to the fixing sleeve receiving portion.

In some embodiments, the first housing portion further comprises a first housing outer surface, opposite to and encompassing the first housing inner surface. When the universal coaxial cable fixing sleeve is engaged to a first connector of the coaxial cable connector system, a fixing sleeve receiving inner surface of a fixing sleeve receiving portion of the first connector correspond to and engage with the first housing outer surface, and no re-preparation of the cable is required, and when the universal coaxial cable fixing sleeve is engaged to a second connector of an alternative coaxial cable connector system, a fixing sleeve receiving inner surface of a fixing sleeve receiving portion of the second connector correspond to and engage with the first housing outer surface, and no re-preparation of the cable is required.

In some embodiments the first gripping component comprises a first proximal base, a first distal base, and a plurality of elastic arches. An end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled thereto, each of the crowns of the plurality of elastic arches is deformed to grip the conductive shield of the cable.

In some embodiments, the second gripping component comprises a second distal base and a plurality of elastic fingers, each plurality of elastic fingers having a finger gripping end and a finger base end, wherein the diameter of the finger gripping end is less than the diameter of the finger base end. The finger base end is integrally formed with the second distal base and the second distal base is fixedly attached to the housing distal end. The ring inner ramp of the deflecting ring is positioned flush against the plurality of elastic fingers, facilitating radially inward positioning at an angle of inward incline. When a cable of the coaxial cable connector system is assembled through the second gripping component, each of the finger gripping ends of the plurality of elastic fingers are moved radially inward to grip the protective outer jacket of the cable, hindering removal of the cable.

In some embodiments, the third gripping component comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and an inner elastic slope. A portion of the third gripping proximal end and third gripping outer surface is fixedly attached within the ring distal inner groove and a portion of the third gripping distal end and third gripping outer surface is fixedly attached to the second sleeve inner surface, and second sleeve ledge. When a cable of the coaxial cable connector system is assembled through the third gripping component, the inner flat compression portion is deformed and compressed to grip the protective outer jacket of the cable, hindering removal of the cable and creating a weatherproof seal around the cable.

In some embodiments, the first and second connectors comprise BNC, TNC, SMA, N-Type, F-Type, and MCX and RCA connector types and are not the same. The first housing outer surface is configured to engage within the fixing sleeve receiving inner surface of the BNC, TNC, SMA, N-Type, F-Type, and MCX and RCA connector types.

In some embodiments, the angle of inward incline of the elastic slope of the third gripping component is between 20° degrees to 35° degrees. The angle of inward incline of the elastic slope facilitates deformation and compression of the inner flat compression portion to grip the protective outer jacket of the cable.

In an embodiment, an alternative coaxial cable connector system comprising a coaxial connector, a coaxial cable, and a coaxial cable fixing sleeve is provided. The coaxial cable connector comprises a nut. The nut, defining an interior channel therethrough, comprises a mating end portion configured to couple with a mating connector. The rotating portion includes a first nut inner surface having a nut sliding wall between the slidable distal end and first nut inner surface and a second nut inner surface.

The coaxial cable fixing sleeve comprises a main housing, a receiving sleeve, a first housing portion, a first gripping component, a second gripping component, a deflecting ring, and a third gripping component. The main housing, defining an interior channel therethrough, comprises a main housing proximal portion and a main housing distal portion. The main housing proximal portion has a main housing proximal end and a main housing proximal inner surface and the main housing distal portion has a main housing distal end opposite the main housing proximal end and a main housing outer surface having a main housing stop wall between the main housing distal end and main housing proximal end. The main housing proximal end rests flush against the slidable distal end.

The receiving sleeve, defining an interior channel therethrough, includes a proximal sleeve end, a first sleeve portion, and a second sleeve portion. The first sleeve portion has a first sleeve inner surface, a central sleeve inner surface, and a central sleeve stop wall. The second sleeve portion has a second sleeve inner surface and a second sleeve ledge at a distal end thereof. The central sleeve stop wall is between the proximal sleeve end and second sleeve ledge. The proximal sleeve end and first sleeve inner surface rests flush against the main housing stop wall and main housing outer surface, respectively.

The first housing portion, defining an interior channel therethrough, includes a first housing outer surface and a first housing inner surface. The first housing outer surface has a first housing outer ring surface and a first housing outer connection surface having a first housing outer stop wall. The first housing inner surface has a proximal housing ledge at a proximal end thereof and a distal housing ledge at a distal end thereof. The first housing outer ring surface and first housing outer surface rests against the first nut inner surface and nut surface, respectively. The first housing outer connection surface rests flush against the second nut inner surface and main housing proximal inner surface.

The first gripping component is fixedly attached to the first housing inner surface and the second gripping component has one end fixedly attached to the housing distal end. The deflecting ring has a ring inner ramp positioned flush against the second gripping component, a ring outer surface fixedly attached to the central sleeve inner surface, and a ring distal inner groove opposite the ring inner ramp. The third gripping component is fixedly attached within the ring distal inner groove, second sleeve inner surface, and second sleeve ledge.

The coaxial cable has a center conductor, surrounded by a dielectric core, which is covered by at least a conductive shield and a protective outer jacket. When the coaxial cable is assembled to the coaxial cable connector, the first gripping component grips a conductive shield of the cable, and the second and third gripping components grip a protective outer jacket of the cable, respectively. The individual gripping of the conductive shield and protective outer jacket are each, positioned in at least three concentric and evenly separated positions.

In some embodiments, the first gripping component of the alternative coaxial cable connector system comprises a first proximal base, a first distal base, and a plurality of elastic arches. An end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled thereto, each of the crowns of the plurality of elastic arches is deformed to grip the conductive shield of the cable.

In some embodiments, the second gripping component of the alternative coaxial cable connector system comprises a second distal base and a plurality of elastic fingers, each plurality of elastic fingers having a finger gripping end and a finger base end, wherein the diameter of the finger gripping end is less than the diameter of the finger base end. The finger base end is integrally formed with the second distal base and the second distal base is fixedly attached to the housing distal end. The ring inner ramp of the deflecting ring is positioned flush against the plurality of elastic fingers, facilitating radially inward positioning at an angle of inward incline. When a cable of the coaxial cable connector system is assembled through the second gripping component, each of the finger gripping ends of the plurality of elastic fingers are moved radially inward to grip the protective outer jacket of the cable, hindering removal of the cable.

In some embodiments, the third gripping component of the alternative coaxial cable connector system comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and an inner elastic slope. A portion of the third gripping proximal end and third gripping outer surface is fixedly attached within the ring distal inner groove and a portion of the third gripping distal end and third gripping outer surface is fixedly attached to the second sleeve inner surface, and second sleeve ledge. When a cable of the coaxial cable connector system is assembled through the third gripping component, the inner flat compression portion is deformed and compressed to grip the protective outer jacket of the cable, hindering removal of the cable and creating a weatherproof seal around the cable.

In some embodiments, the coaxial cable connector of the alternative coaxial cable connector system is an F-Type connector type. In some embodiments, the angle of inward incline of the elastic slope of the third gripping component of the alternative coaxial cable connector system is between 20° degrees to 35° degrees. The angle of inward incline of the elastic slope facilitates deformation and compression of the inner flat compression portion to grip the protective outer jacket of the cable.

In an embodiment, a universal coaxial cable fixing sleeve of a coaxial cable connector system comprising a housing, a receiving sleeve, a first gripping component, a second gripping component, a deflecting ring, and a third gripping component is provided. The housing, defining an interior channel therethrough, comprises a first housing portion including a first housing inner surface, a second housing portion having a second housing outer surface and a second housing stop wall between the first housing portion and second housing outer surface, and a housing distal end. The receiving sleeve, defining an interior channel therethrough, includes a proximal sleeve end, a first sleeve portion and a second sleeve portion. The first sleeve portion has a first sleeve inner surface, a central sleeve inner surface, and a central sleeve stop wall. The second sleeve portion has a second sleeve inner surface and a second sleeve ledge at a distal end thereof. The central sleeve stop wall is between the proximal sleeve end and second sleeve ledge, whereby when assembled, the proximal sleeve end and first sleeve inner surface rests flush against the second housing stop wall and the second housing outer surface, respectively.

The first gripping component is fixedly attached to the first housing inner surface and the second gripping component has one end fixedly attached to the housing distal end. The deflecting ring has a ring inner ramp positioned flush against the second gripping component, a ring outer surface fixedly attached to the central sleeve inner surface, and a ring distal inner groove opposite the ring inner ramp. The third gripping component is fixedly attached within the ring distal inner groove, second sleeve inner surface, and second sleeve ledge.

When the coaxial cable is assembled to the universal coaxial cable fixing sleeve, the first gripping component grips a conductive shield of the cable, and the second and third gripping components grip a protective outer jacket of the cable, respectively. The individual gripping of the conductive shield and protective outer jacket are each, positioned in at least three concentric and evenly separated positions and when the universal coaxial cable fixing sleeve is assembled to a coaxial connector, the first housing portion is fixedly engaged to a fixing sleeve receiving portion of the coaxial connector.

In some embodiments of the universal coaxial cable fixing sleeve, the first housing portion further comprises a first housing outer surface, opposite to and encompassing the first housing inner surface. When the universal coaxial cable fixing sleeve is engaged to a first connector of the coaxial cable connector system, a fixing sleeve receiving inner surface of a fixing sleeve receiving portion of the first connector correspond to and engage with the first housing outer surface, and no re-preparation of the cable is required, and when the universal coaxial cable fixing sleeve is engaged to a second connector of an alternative coaxial cable connector system, a fixing sleeve receiving inner surface of a fixing sleeve receiving portion of the second connector correspond to and engage with the first housing outer surface, and no re-preparation of the cable is required.

In some embodiments of the universal coaxial cable fixing sleeve, the first gripping component comprises a first proximal base, a first distal base, and a plurality of elastic arches. An end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled thereto, each of the crowns of the plurality of elastic arches is deformed to grip the conductive shield of the cable.

In some embodiments of the universal coaxial cable fixing sleeve, the second gripping component comprises a second distal base and a plurality of elastic fingers, each plurality of elastic fingers having a finger gripping end and a finger base end, wherein the diameter of the finger gripping end is less than the diameter of the finger base end. The finger base end is integrally formed with the second distal base and the second distal base is fixedly attached to the housing distal end. The ring inner ramp of the deflecting ring is positioned flush against the plurality of elastic fingers, facilitating radially inward positioning at an angle of inward incline. When a cable of the coaxial cable connector system is assembled through the second gripping component, each of the finger gripping ends of the plurality of elastic fingers are moved radially inward to grip the protective outer jacket of the cable, hindering removal of the cable.

In some embodiments of the universal coaxial cable fixing sleeve, the third gripping component comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and an inner elastic slope. A portion of the third gripping proximal end and third gripping outer surface is fixedly attached within the ring distal inner groove and a portion of the third gripping distal end and third gripping outer surface is fixedly attached to the second sleeve inner surface, and second sleeve ledge. When a cable of the coaxial cable connector system is assembled through the third gripping component, the inner flat compression portion is deformed and compressed to grip the protective outer jacket of the cable, hindering removal of the cable and creating a weatherproof seal around the cable.

In some embodiments of the universal coaxial cable fixing sleeve, the first and second connectors comprise BNC, TNC, SMA, N-Type, F-Type, and MCX and RCA connector types and are not the same. The first housing outer surface is configured to engage within the fixing sleeve receiving inner surface of the BNC, TNC, SMA, N-Type, F-Type, and MCX and RCA connector types.

In some embodiments of the universal coaxial cable fixing sleeve, the angle of inward incline of the elastic slope of the third gripping component is between 20° degrees to 35° degrees. The angle of inward incline of the elastic slope facilitates deformation and compression of the inner flat compression portion to grip the protective outer jacket of the cable.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several examples of heatsink fins incorporating aspects of the presently disclosed principles are illustrated by way of example, and not by way of limitation.

DETAILED DESCRIPTION

Figure 1A:
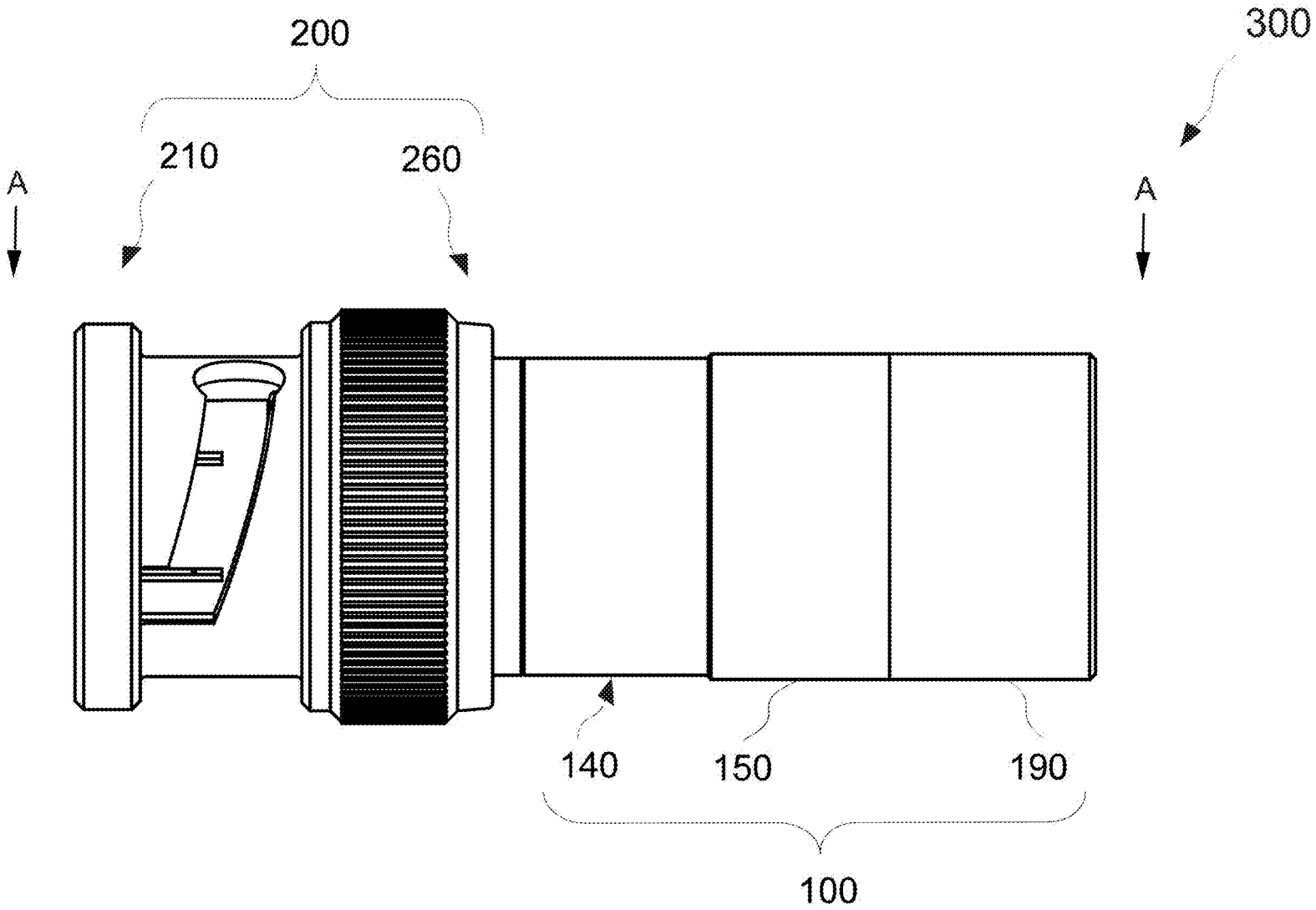
FIG. 1A is a schematic perspective first view of a coaxial cable connector and coaxial cable fixing sleeve, according to an example embodiment.

The following describes various principles related to communication systems by way of reference to specific examples of cabling infrastructure, including arrangements and examples of coaxial connectors and cables embodying innovative concepts. More particularly, but not exclusively, such innovative principles are described in relation to selected examples of coaxial connectors and cables and well-known functions or constructions are described in detail for purposes of succinctness and clarity. Nonetheless, one or more of the disclosed principles can be incorporated in various other embodiments of coaxial connectors and cables to achieve any of a variety of desired outcomes, characteristics, and/or performance criteria.

Thus, coaxial connectors and cables having attributes that are different from those specific examples discussed herein can embody one or more of the innovative principles, and can be used in applications not described herein in detail. Accordingly, embodiments of coaxial connectors and cables not described herein in detail also fall within the scope of this disclosure, as will be appreciated by those of ordinary skill in the relevant art following a review of this disclosure.

Example embodiments as disclosed herein are directed to coaxial cable connectors, coaxial cable systems, and universal coaxial cable fixing sleeves thereof. In an embodiment, a coaxial cable connector system comprises a coaxial connector, a coaxial cable, and a universal coaxial cable fixing sleeve is provided. The universal coaxial cable fixing sleeve comprises a first gripping component, a second gripping component, and a third gripping component. When the coaxial cable is assembled to the universal coaxial cable fixing sleeve, the first gripping component grips a conductive shield of the cable, and the second and third gripping components grip a protective outer jacket of the cable, respectively. When the universal coaxial cable fixing sleeve is engaged to a first connector, a first housing outer surface thereof corresponds to and fixedly engages with a sleeve receiving inner surface of the first connector, and when disengaged and engaged to a second connector different in type from the first connector, no re-preparation of the cable is required for corresponding fixed engagement.

In some embodiments the coaxial cable connectors may be applicable to, as an example and not to be limiting, communications equipment and patch panels, providing physical connection to networks and devices. Generally, the coaxial cable connector type of the universal coaxial cable fixing sleeve of the embodiments is a BNC, TNC, SMA, N-Type, F-Type, and MCX and RCA connector type having impedances of 50 Ohm and/or 75 Ohm. A cable is inserted and assembled to the universal coaxial cable fixing sleeve and the universal coaxial cable fixing sleeve having the cable may be inserted into more than one connector type. Those of ordinary skill in the relevant art may readily appreciate, that the coaxial cable connectors of the embodiments may be of connector types other than those mentioned above, as long as the universal coaxial cable fixing sleeve having the cable assembled thereto, may be inserted into more than one connector type, and the embodiments are not limited thereto.

Prior to coupling the coaxial cable connector of the embodiments to a mating connector, the end of a cable to be received by the mating connector must first be prepared. Generally, a cutting tool (not shown) is used by an installer to expose a portion of a center conductor, a length of a dielectric core, and a length of a conductive shield, all in accordance with industry standards. Those of ordinary skill in the relevant art may readily appreciate that the cable may further comprise one or more layers of an electrically conductive foil underlying the conductive shield and the embodiments are not limited thereto. The thickness of the conductive shield and outer diameter of a protective outer jacket may vary, depending on a manufacturer.

Figure 1B:
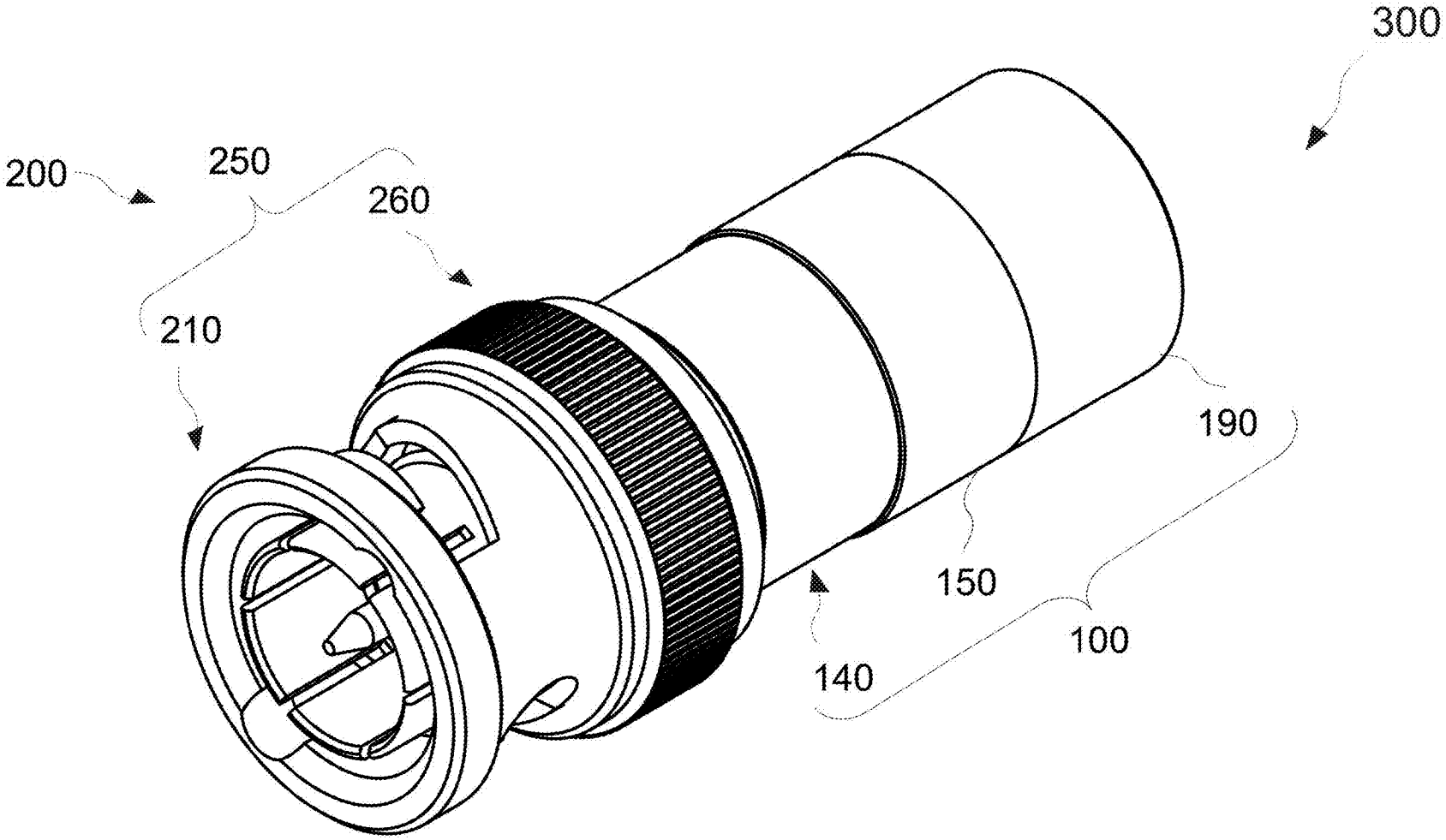
FIG. 1B is a schematic perspective second view of the coaxial cable connector and coaxial cable of FIG. 1A, according to an example embodiment.
Figure 1C:
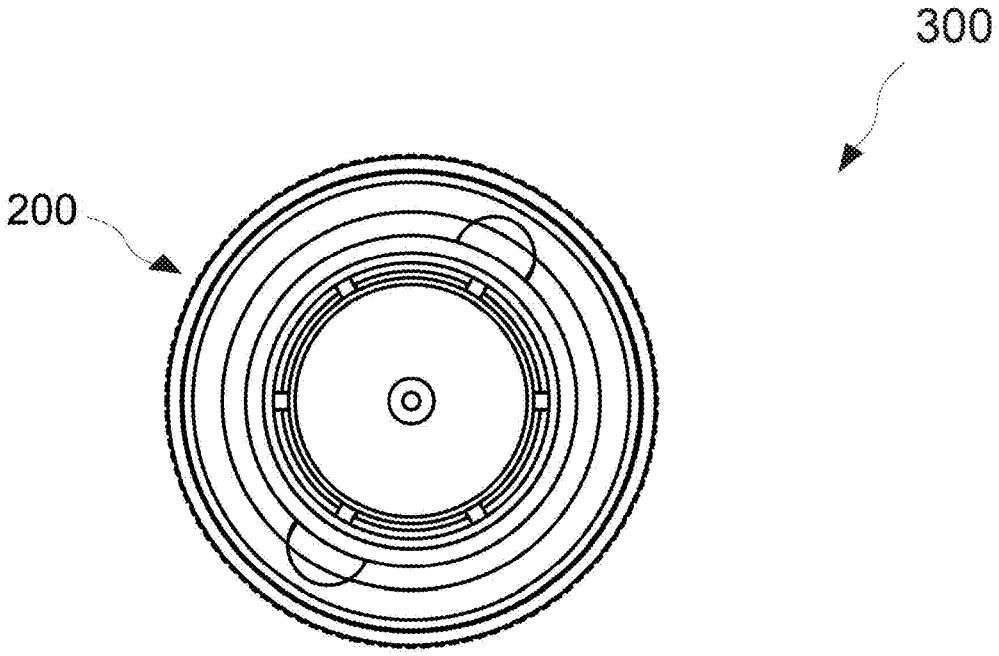
FIG. 1C is a schematic perspective third view of the coaxial cable connector and coaxial cable of FIG. 1A from the connector side, according to an example embodiment.
Figure 1D:
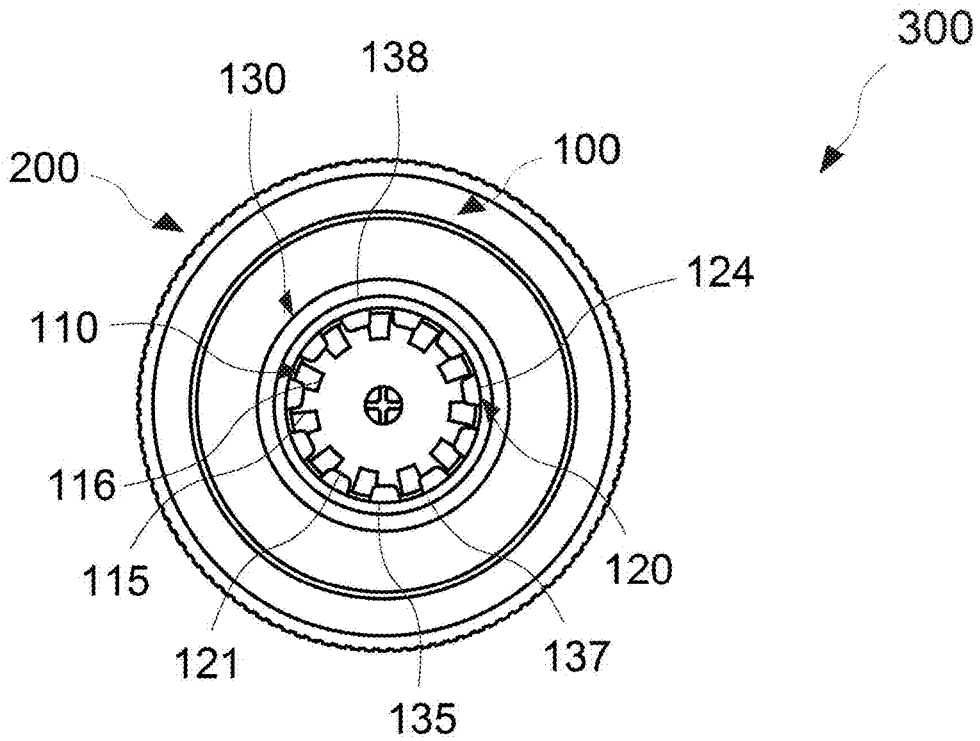
FIG. 1D is a schematic perspective fourth view of the coaxial cable connector and coaxial cable of FIG. 1A from the cable side, according to an example embodiment.
Figure 1E:
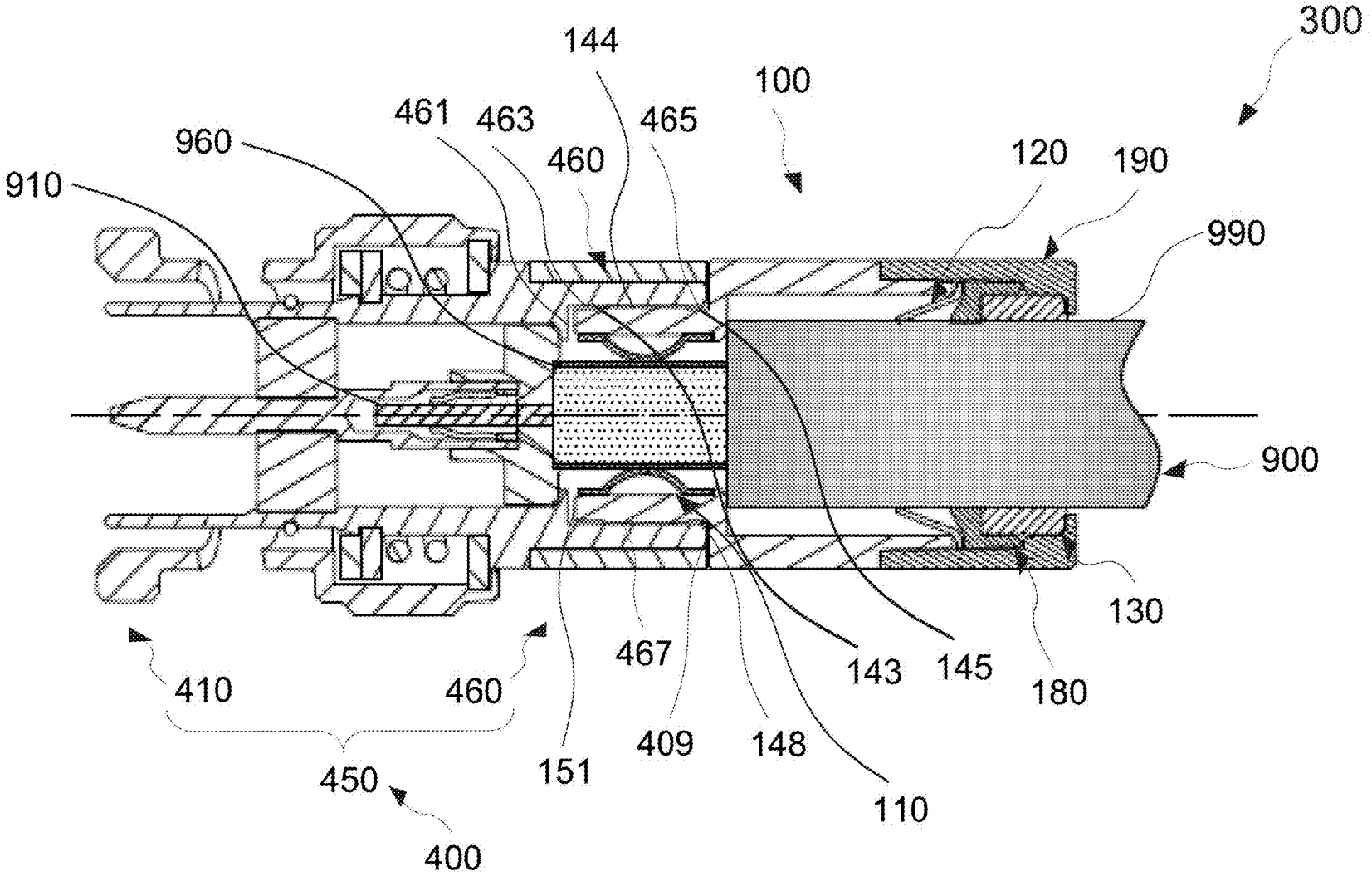
FIG. 1E is a schematic cross-sectional view of a coaxial cable connector system including the coaxial cable connector and coaxial cable of FIG. 1A along line A-A in FIG. 1A with an engaged coaxial cable, according to an example embodiment.
Figure 2:
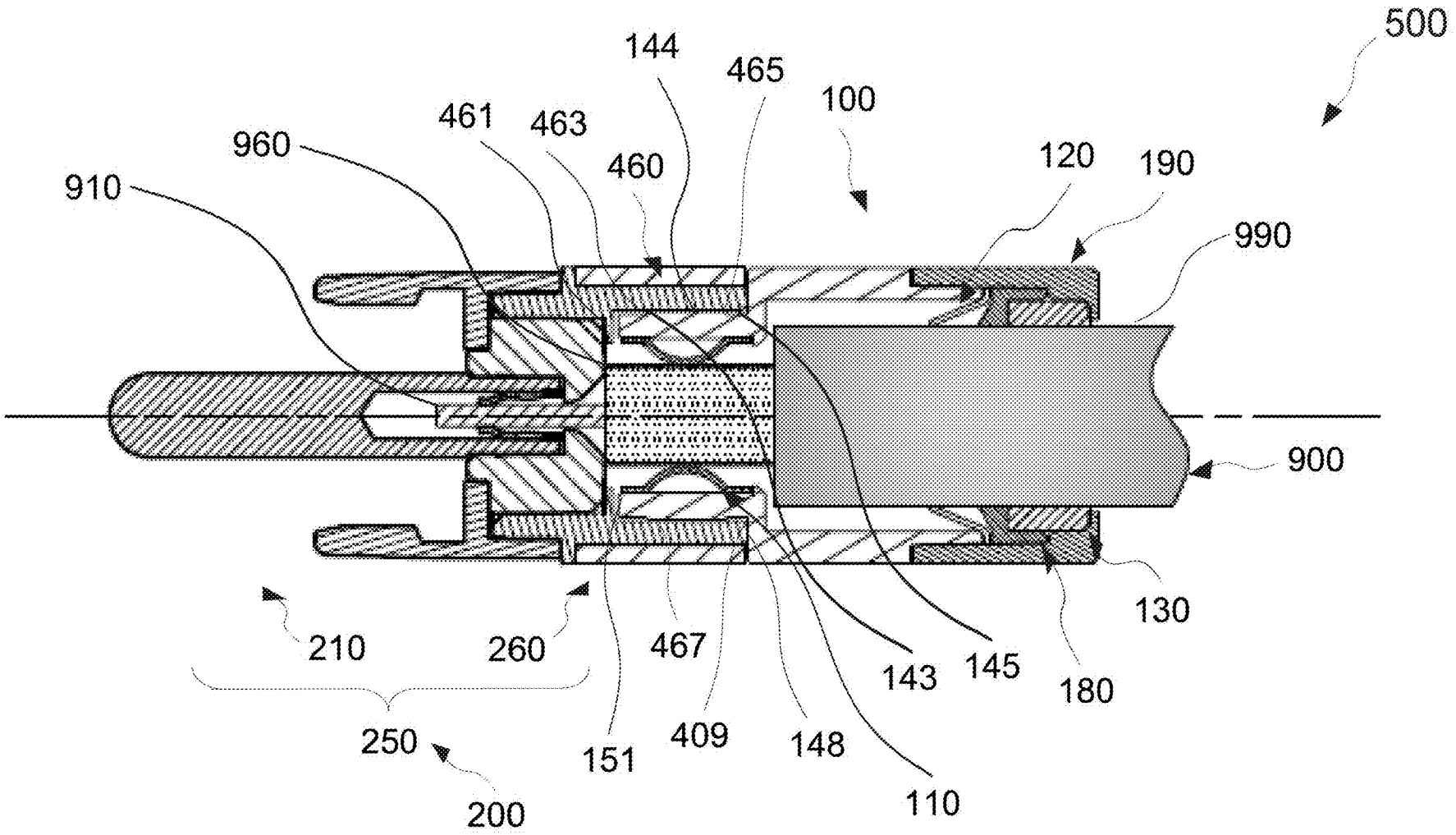
FIG. 2 is a schematic cross-sectional view of an alternative coaxial cable connector system, according to an example embodiment.

FIG. 1A is a schematic perspective first view of a coaxial cable connector and coaxial cable fixing sleeve, according to an example embodiment. FIG. 1B is a schematic perspective second view of the coaxial cable connector and coaxial cable of FIG. 1A, according to an example embodiment. FIG. 1C is a schematic perspective third view of the coaxial cable connector and coaxial cable of FIG. 1A from the connector side, according to an example embodiment. FIG. 1D is a schematic perspective fourth view of the coaxial cable connector and coaxial cable of FIG. 1A from the cable side, according to an example embodiment. FIG. 1E is a schematic cross-sectional view of a coaxial cable connector system including the coaxial cable connector and coaxial cable of FIG. 1A along line A-A in FIG. 1A with an engaged coaxial cable, according to an example embodiment. FIG. 2 is a schematic cross-sectional view of an alternative coaxial cable connector system, according to an example embodiment. Referring to FIGS. 1A to 2, in an embodiment, a coaxial cable connector system 300, 500 comprises a coaxial connector 200, 400 a coaxial cable 900, and a universal coaxial cable fixing sleeve 100. The coaxial connector 200, 400 comprises a nut 250, 450, defining an interior channel therethrough, comprising a mating end portion 210, 410 and a fixing sleeve receiving portion 260, 460. The mating end portion 210, 410 is configured to couple with a mating connector (not shown). The fixing sleeve receiving portion 260, 460 includes a distal fixing sleeve receiving end 209, 409 and a fixing sleeve receiving inner surface 267, 467 having a fixing sleeve receiving stop wall 261, 461. The coaxial cable 900 has a center conductor 910, surrounded by a dielectric core, which is covered by at least a conductive shield 960 and a protective outer jacket 990.

The universal coaxial cable fixing sleeve 100 comprises a housing 150, a receiving sleeve 190, a first gripping component 110, a second gripping component 120, a deflecting ring 180, and a third gripping component 130. The housing 150, defining an interior channel therethrough, comprises a first housing portion 140 including a first housing inner surface 147 having a first housing ledge 149 at a distal end thereof, a second housing portion 160 having a second housing outer surface 164 and a second housing stop wall 161 between the first and second housing 150 ends, and a housing distal end 159. The receiving sleeve 190, defining an interior channel therethrough, includes a proximal sleeve end 191, a first sleeve portion 193 and a second sleeve portion 197. The first sleeve portion 193 has a first sleeve inner surface 192, a central sleeve inner surface 194, and a central sleeve stop wall 195. The second sleeve portion 197 has a second sleeve inner surface 196 and a second sleeve ledge 198 at a distal end thereof. The central sleeve stop wall 195 is between the proximal sleeve end 191 and the second sleeve ledge 198, whereby when assembled, the proximal sleeve end 191 rests flush against the second housing stop wall 161 and the second housing outer surface 164.

The first gripping component 110 is fixedly attached to the first housing inner surface 147 and has one end resting flush against the first housing ledge 149 and an opposite end resting flush against the distal housing ledge 149. The second gripping component 120 has one end fixedly attached to the housing distal end 159 and against the central sleeve inner surface 194. The deflecting ring 180 has a ring inner ramp 181 positioned flush against the second gripping component 120, a ring outer surface 187 fixedly attached to the central sleeve inner surface 194, and a ring distal inner groove 185 opposite the ring inner ramp 181. The third gripping component 130 is fixedly attached within the ring distal inner groove 185, second sleeve inner surface 196, and second sleeve ledge 198.

When the coaxial cable 900 is assembled to the universal coaxial cable fixing sleeve 100, the first gripping component 110 grips a conductive shield 960 of the cable 900, and the second and third gripping components 120, 130 grip a protective outer jacket 990 of the cable 900, respectively. The individual gripping of the conductive shield 960 and protective outer jacket 990 are each, positioned in at least three concentric and evenly separated positions and when the universal coaxial cable fixing sleeve 100 is assembled to the coaxial connector 200, 400, the first housing portion 140 is snap press fit engaged to the fixing sleeve receiving portion 260.

In some embodiments, the first housing portion 140 further comprises a first housing proximal end 151, opposite the first housing distal end 159, a first housing outer surface 144, opposite to and encompassing the first housing inner surface 147, having a first housing stop wall 148 between the first housing proximal end 151 and second housing stop wall 161, and a first housing proximal outer surface groove 143 and a first housing distal outer surface groove 145. When the universal coaxial cable fixing sleeve 100 is engaged to a first connector 200 of the coaxial cable connector system 300, protrusions 263, 265 of a fixing sleeve receiving inner surface 267 of a fixing sleeve receiving portion 260 of the first connector 200 correspond to and snap press fit engage into the first housing proximal and first housing distal outer surface grooves 143, 145, respectively, and the first housing proximal end 151 rests flush against a fixing sleeve receiving stop wall 261 of the fixing sleeve receiving portion 260 and a distal fixing sleeve receiving end 209, 409 rests flush against a portion of the first housing stop wall 148, and no re-preparation of the cable 900 is required. When the universal coaxial cable fixing sleeve 100 is engaged to a second connector 400 of an alternative coaxial cable connector system 800, protrusions 263, 265 of a fixing sleeve receiving inner surface 267 of a fixing sleeve receiving portion 260 of the second connector 400 correspond to and snap press fit engage into the first housing proximal and first housing distal outer surface grooves 143, 145, respectively, and the first housing proximal end 151 rests flush against a fixing sleeve receiving stop wall 261 of the fixing sleeve receiving portion 260 and a distal fixing sleeve receiving end 209, 409 rests flush against a portion of the first housing stop wall 148, and no re-preparation of the cable 900 is required.

In some embodiments, a depth of the first housing stop wall 148 is greater than a thickness of the fixing sleeve receiving portion 260, 460 and a diameter of the sleeve receiving inner surface 187 is larger than a diameter of the first housing outer surface 144 for snap press fit engagement thereto. The diameter of the protective outer jacket 990 is larger than a diameter of the first housing inner surface 147. When the universal coaxial cable fixing sleeve 100 is engaged to a connector, protrusions 263, 265, 463, 465 of a fixing sleeve receiving inner surface 267, 467 of a fixing sleeve receiving portion 260, 460 of the coaxial cable connector 200, 400 correspond to and snap press fit engage into the first housing proximal and first housing distal outer surface grooves 143, 145, respectively. The snap press fit engagement may also comprise friction fit or contact fit; however the embodiments are not limited thereto. Those of ordinary skill in the relevant art may readily appreciate that other types of connecting methods may be used, as long as the universal coaxial cable fixing sleeve 100 may be disengaged and engaged in different connectors, whereby no re-preparation of the cable 900 is required.

In some embodiments the first gripping component 110 comprises a first proximal base 111, a first distal base 119, and a plurality of elastic arches 115. An end of each of the plurality of elastic arches 115 is integrally formed with the first proximal base 111 and an opposite end of each of the plurality of elastic arches 115 is integrally formed with the first distal base 119. An end of the first distal base 119 opposite the plurality of elastic arches 115 rests flush against the first housing ledge 149 and an end of the first proximal base 111 opposite the plurality of elastic arches 115 rests flush with a housing proximal end 151 of the housing 150 opposite the housing distal end 159. Each of the crowns 116 of the plurality of elastic arches 115 is positioned toward a center of the interior channel. When a cable 900 of the coaxial cable connector system 300 is assembled through the first gripping component 110, each of the crowns 116 of the plurality of elastic arches 115 is deformed to grip the conductive shield 960 of the cable 900.

In some embodiments, the second gripping component 120 comprises a second distal base 129 and a plurality of elastic fingers 125, each plurality of elastic fingers 125 having a finger gripping end 121 and a finger base end 124, wherein a diameter of the finger gripping end 121 is less than a diameter of the finger base end 124. The finger base end 124 is integrally formed with the second distal base 129 and the second distal base 129 is fixedly attached to the housing distal end 159 and against the central sleeve inner surface 194. The ring inner ramp 181 of the deflecting ring 180 is positioned flush against the plurality of elastic fingers 125, facilitating radially inward positioning at an angle of inward incline. When a cable 900 of the coaxial cable connector system 300 is assembled through the second gripping component 120, each of the finger gripping ends 121 of the plurality of elastic fingers 125 are moved radially inward to grip the protective outer jacket 990 of the cable 900, hindering removal of the cable 900.

In some embodiments, the third gripping component 130 comprises a third gripping proximal end 131, a third gripping distal end 139 opposite the third gripping proximal end 131, an inner flat compression portion 135, an inner flat portion 138, an inner elastic slope 137 between the inner flat compression and inner flat portions 135, 138 and a third gripping outer surface 132 opposite to and encompassing the inner flat compression portion 135, inner flat portion 138 and an inner elastic slope 137. A portion of the third gripping proximal end 131 and third gripping outer surface 132 is fixedly attached within the ring distal inner groove 185 and a portion of the third gripping distal end 139 and third gripping outer surface 132 is fixedly attached to the second sleeve inner surface 196, and second sleeve ledge 198. When a cable 900 of the coaxial cable connector system 300 is assembled through the third gripping component 130, the inner flat compression portion 135 is deformed and compressed to grip the protective outer jacket 990 of the cable 900, hindering removal of the cable 900 and creating a weatherproof seal around the cable 900, preventing humidity, moisture, mildew and dirt from passing therethrough.

Figure 3:
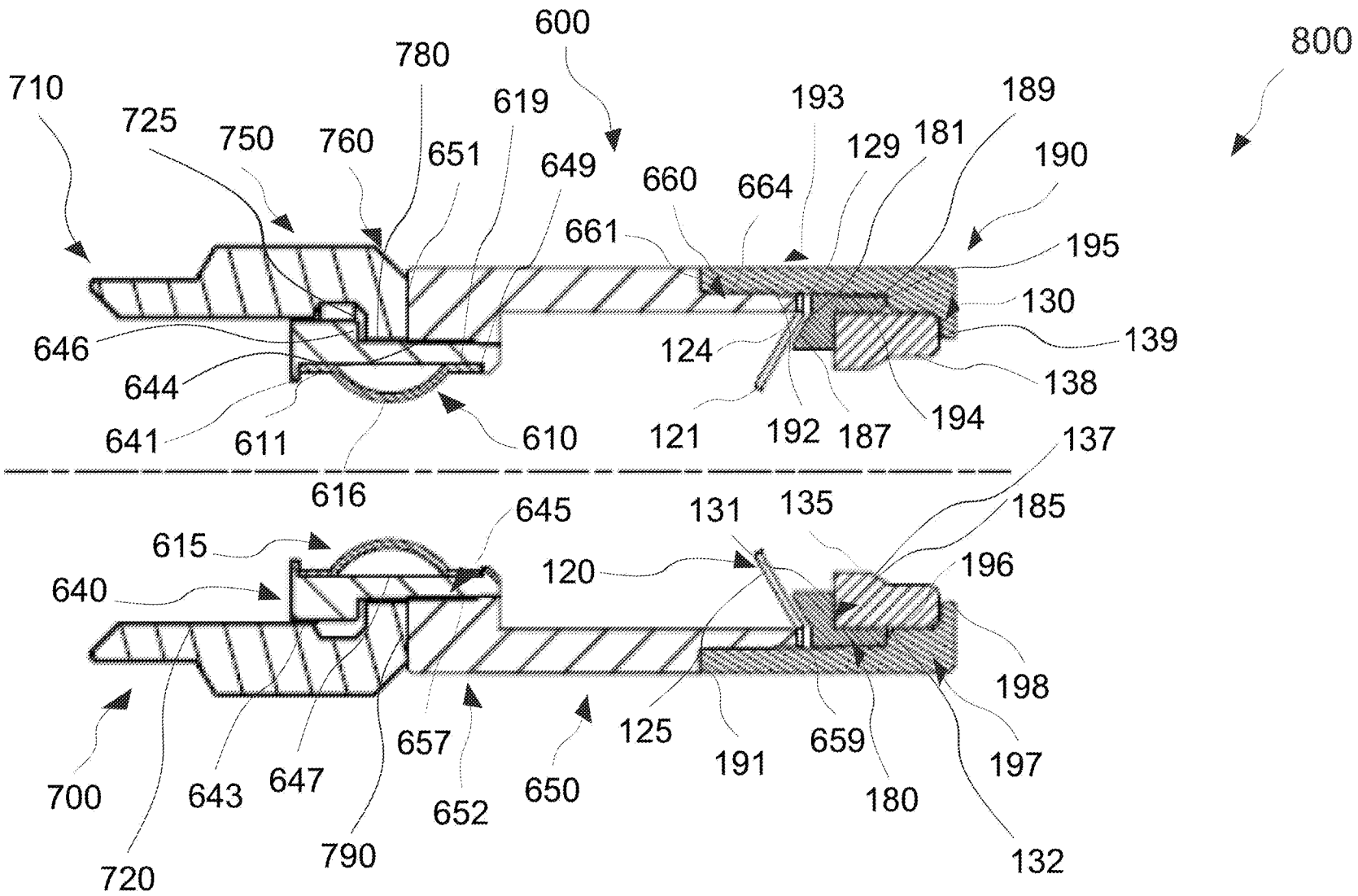
FIG. 3 is a schematic cross-sectional view of another alternative coaxial cable connector system, according to an example embodiment.
Figure 4A:
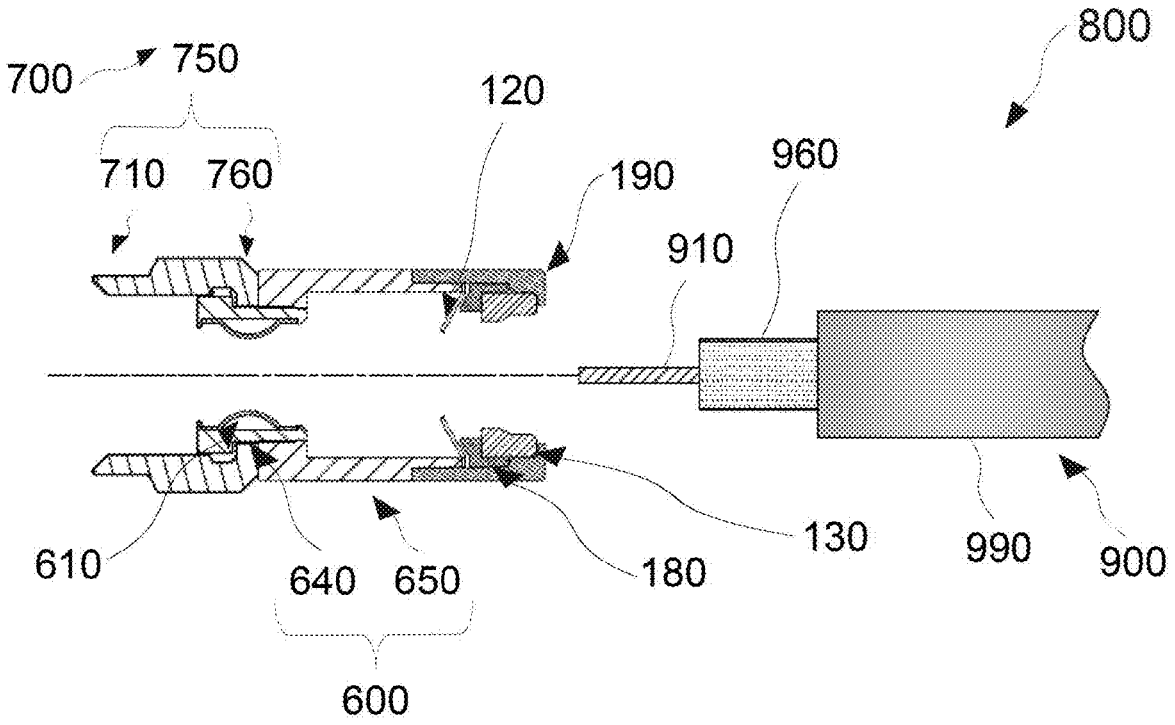
FIG. 4A is a schematic cross-sectional view of the another alternative coaxial connector system of FIG. 3 with a disengaged coaxial cable, according to an example embodiment.
Figure 4B:
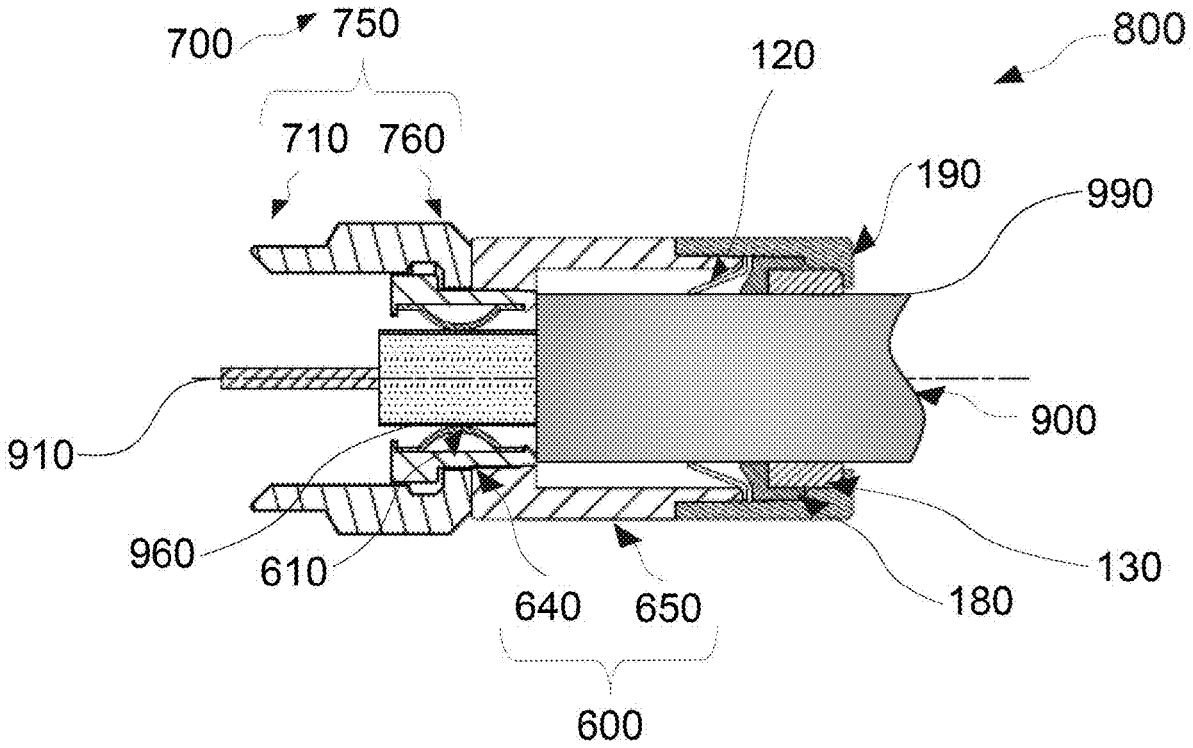
FIG. 4B is a schematic cross-sectional view of an alternative coaxial cable connector system of FIG. 3 with an engaged coaxial cable, according to an example embodiment.

FIG. 3 is a schematic cross-sectional view of another alternative coaxial cable connector system, according to an example embodiment. FIG. 4A is a schematic cross-sectional view of the another alternative coaxial connector system of FIG. 3 with a disengaged coaxial cable, according to an example embodiment. FIG. 4B is a schematic cross-sectional view of an alternative coaxial cable connector system of FIG. 3 with an engaged coaxial cable, according to an example embodiment. Referring to FIGS. 3 to 4B, in an embodiment, another alternative coaxial cable connector system 800 comprises a coaxial cable connector 700, a coaxial cable fixing sleeve 600, and a coaxial cable 900. The coaxial cable connector 700 comprises a nut 750. The nut 750, defining an interior channel therethrough, comprises a mating end portion 710 configured to couple with a mating connector (not shown), a slidable distal end 790, and a rotating portion 760. The mating end portion 710 comprises a first nut inner surface 720 having a nut sliding wall 725 between the slidable distal end 790 and first nut inner surface 720 and a second nut inner surface 780.

The coaxial cable fixing sleeve 600 comprises a main housing 650, a receiving sleeve 190, a first housing portion 640, a first gripping component 610, a second gripping component 120, a deflecting ring 180, and a third gripping component 130. The main housing 650, defining an interior channel therethrough, comprises a main housing proximal portion 652 and a main housing distal portion 660. The main housing proximal portion 652 has a main housing proximal end 651 and a main housing proximal inner surface 657 and the main housing distal portion 660 has a main housing distal end 659 opposite the main housing proximal end 651 and a main housing outer surface 664 having a main housing stop wall 661 between the main housing distal end 659 and main housing proximal end 651. The main housing proximal end 651 rests flush against the slidable distal end 790.

The receiving sleeve 190, defining an interior channel therethrough, includes a proximal sleeve end 191, a first sleeve portion 193, and a second sleeve portion 197. The first sleeve portion 193 has a first sleeve inner surface 192, a central sleeve inner surface 194, and a central sleeve stop wall 195. The second sleeve portion 197 has a second sleeve inner surface 196 and a second sleeve ledge 198 at a distal end thereof. The central sleeve stop wall 195 is between the proximal sleeve end 191 and the second sleeve ledge 198. The proximal sleeve end 191 and first sleeve inner surface 192 rests flush against the main housing stop wall 661 and the second housing outer surface 664, respectively.

The first housing portion 640, defining an interior channel therethrough, includes a first housing outer surface 645 and a first housing inner surface 647. The first housing outer surface 645 has a first housing outer ring surface 643 and a first housing outer connection surface 644 having a first housing outer stop wall 646. The first housing inner surface 647 has a proximal housing ledge 141 at a proximal end thereof and a distal housing ledge 149 at a distal end thereof. The first housing outer ring surface 143 and first housing outer surface 144 rests against the first nut inner surface 720 and nut surface 730, respectively. The first housing outer connection surface 644 rests flush against the second nut inner surface 780 and main housing proximal inner surface 657. The nut 750 is rotatable around the first housing outer ring surface 643, first housing outer stop wall 646, and a portion of the first housing outer connection surface 644, sliding along the main housing proximal end 651, for secure coupling with a mating connector.

In some embodiments, a depth between planes of the first and second nut inner surfaces 720, 780 is the same as a depth of the first housing outer stop wall 646, cross-sectional lengths of the second nut inner surface 780 and main housing proximal inner surface 657 is equal to a cross-sectional length of the first housing outer connection surface 644, and the diameter of the protective outer jacket 990 is larger than a diameter of the first housing inner surface 147.

The first gripping component 610 is fixedly attached to the first housing inner surface 647 having one end resting flush against the proximal housing ledge 641 and an opposite end resting flush against the distal housing ledge 649. The second gripping component 120 has one end fixedly attached to the main housing distal end 659 and against the central sleeve inner surface 194. The deflecting ring 180 has a ring inner ramp 181 positioned flush against the second gripping component 120, a ring outer surface 187 fixedly attached to the central sleeve inner surface 194, and a ring distal inner groove 185 opposite the ring inner ramp 181. The third gripping component 130 is fixedly attached within the ring distal inner groove 185, second sleeve inner surface 196, and second sleeve ledge 198.

The coaxial cable 900 has a center conductor 910, surrounded by a dielectric core, which is covered by at least a conductive shield 960 and a protective outer jacket 990. When the coaxial cable 900 is assembled to a mating connector (not shown), the first gripping component 610 grips a conductive shield 960 of the cable 900, and the second and third gripping components 120, 130 grip a protective outer jacket 990 of the cable 900, respectively. The individual gripping of the conductive shield 960 and protective outer jacket 990 are each, positioned in at least three concentric and evenly separated positions.

In some embodiments, the first gripping component 610 of the another alternative coaxial cable connector system 800 comprises a first proximal base 611, a first distal base 619, and a plurality of elastic arches 615. An end of each of the plurality of elastic arches 615 is integrally formed with the first proximal base 611 and an opposite end of each of the plurality of elastic arches 615 is integrally formed with the first distal base 619. An end of the first distal base 619 opposite the plurality of elastic arches 615 rests flush against the distal housing ledge 649 and an end of the first proximal base 611 opposite the plurality of elastic arches 615 rests flush with the proximal housing ledge 641 opposite the distal housing ledge 649. Each of the crowns 616 of the plurality of elastic arches 615 is positioned toward a center of the interior channel. When a cable 900 of the coaxial cable connector system 800 is assembled through the first gripping component 610, each of the crowns 616 of the plurality of elastic arches 615 is deformed to grip the conductive shield 960 of the cable 900.

In some embodiments, the second gripping component 120 of the another alternative coaxial cable connector system 800 comprises a second distal base 129 and a plurality of elastic fingers 125, each plurality of elastic fingers 125 having a finger gripping end 121 and a finger base end 124, wherein a diameter of the finger gripping end 121 is less than a diameter of the finger base end 124. The finger base end 124 is integrally formed with the second distal base 129 and the second distal base 129 is fixedly attached to the housing distal end 159 and against the central sleeve inner surface 194. The ring inner ramp 181 of the deflecting ring 180 is positioned flush against the plurality of elastic fingers 125, facilitating radially inward positioning at an angle of inward incline. When a cable 900 of the coaxial cable connector system 300 is assembled through the second gripping component 120, each of the finger gripping ends 121 of the plurality of elastic fingers 125 are moved radially inward to grip the protective outer jacket 990 of the cable 900, hindering removal of the cable 900.

In some embodiments, the third gripping component 130 of the another alternative coaxial cable connector system 800 comprises a third gripping proximal end 131, a third gripping distal end 139 opposite the third gripping proximal end 131, an inner flat compression portion 135, an inner flat portion 138, an inner elastic slope 137 between the inner flat compression and inner flat portions 135, 138 and a third gripping outer surface 132 opposite to and encompassing the inner flat compression portion 135, inner flat portion 138 and an inner elastic slope 137. A portion of the third gripping proximal end 131 and third gripping outer surface 132 is fixedly attached within the ring distal inner groove 185 and a portion of the third gripping distal end 139 and third gripping outer surface 132 is fixedly attached to the second sleeve inner surface 196, and second sleeve ledge 198. When a cable 900 of the coaxial cable connector system 300 is assembled through the third gripping component 130, the inner flat compression portion 135 is deformed and compressed to generally a thickness of the inner flat portion 138 to grip the protective outer jacket 990 of the cable 900, hindering removal of the cable 900 and creating a weatherproof seal around the cable 900, preventing humidity, moisture, mildew and dirt from passing therethrough.

In some embodiments, the coaxial cable connector 750 of the another alternative coaxial cable connector system 800 is an F-Type connector type. In some embodiments of the another alternative coaxial cable connector system 800, the amount of the plurality of elastic arches 115 is eleven and the amount of the plurality of elastic fingers 125 is eleven.

In some embodiments of the another alternative coaxial cable connector system 800, the angle of inward incline of each of the plurality of elastic fingers 125 and ring inner ramp 181 is between 50° degrees to 70° degrees and when a cable 900 of the coaxial cable connector system 300 is assembled thereto, the angle of inward incline of each of the plurality of elastic fingers 125 is further inclined inwardly to between 10° degrees to 30° degrees, facilitating gripping of the protective outer jacket 990 of the cable 900, hindering removal of the cable 900.

In some embodiments, the angle of inward incline of the elastic slope 137 of the third gripping component 130 of the another alternative coaxial cable connector system 800 is between 20° degrees to 35° degrees. The angle of inward incline of the elastic slope 137 facilitates deformation and compression of the inner flat compression portion 135 to grip the protective outer jacket 990 of the cable 900.

Figure 5A:
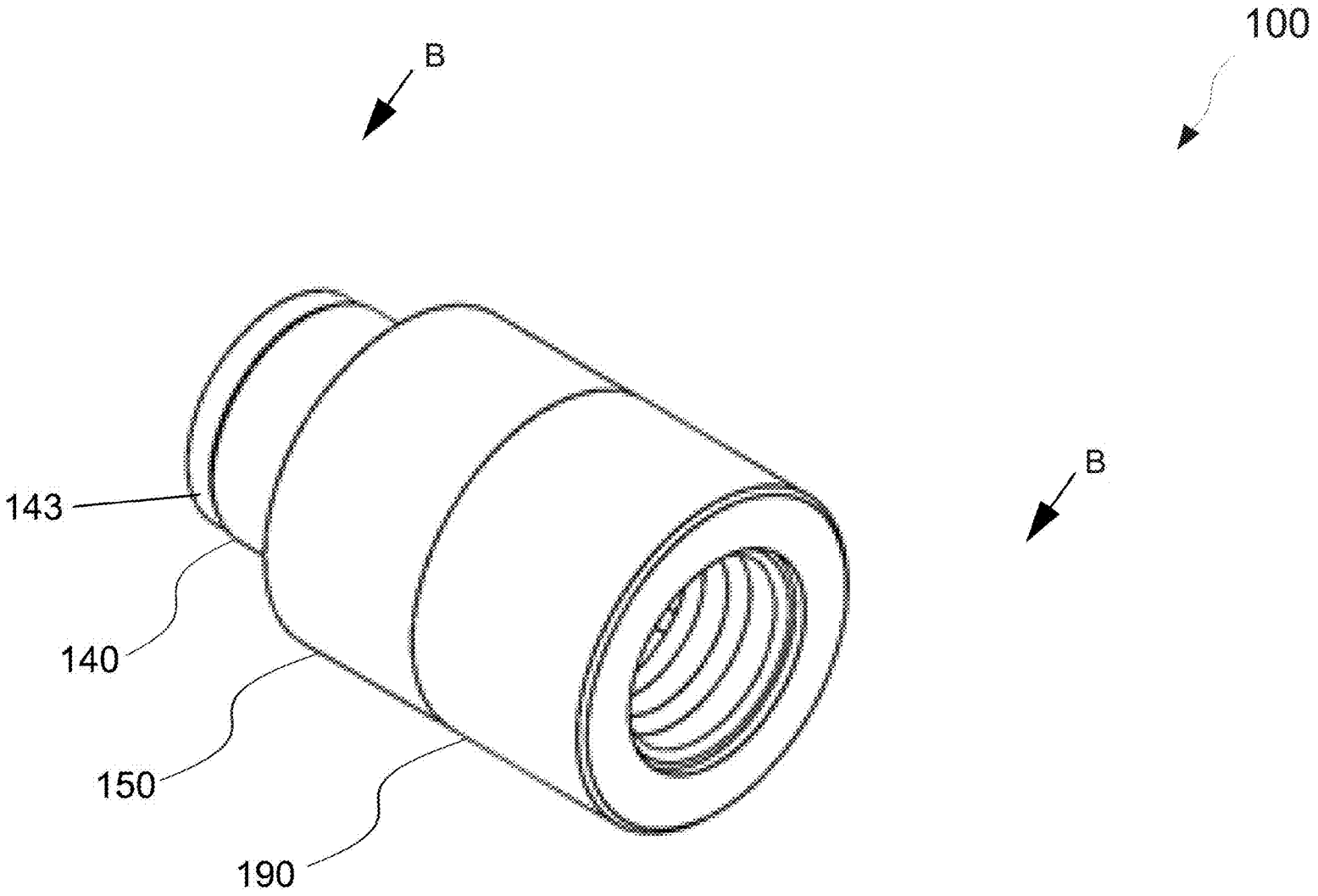
FIG. 5A is a schematic perspective view of the coaxial cable fixing sleeve of FIG. 1, according to an example embodiment.
Figure 5B:
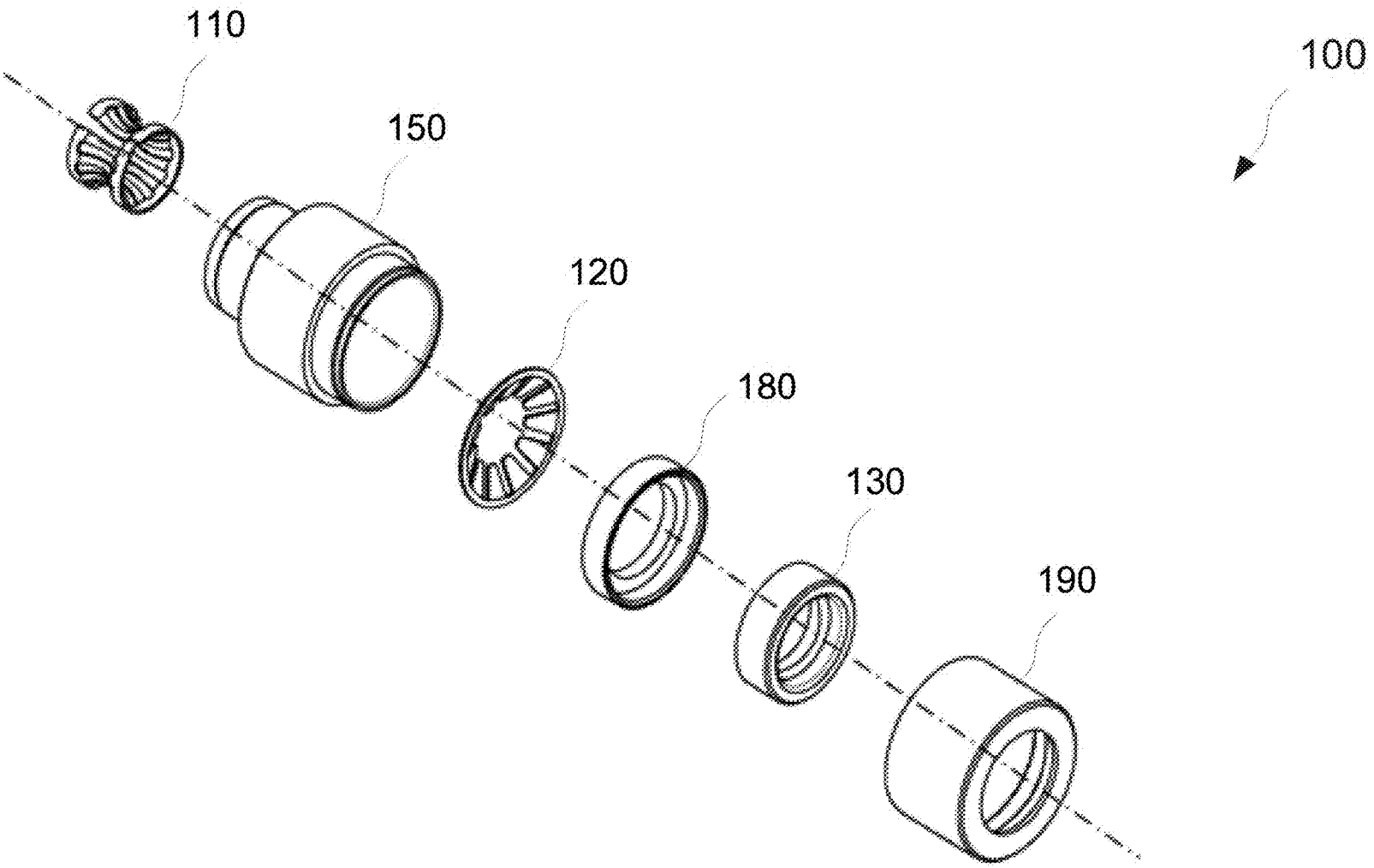
FIG. 5B is a schematic exploded view of the coaxial cable fixing sleeve of FIG. 5A, according to an example embodiment.
Figure 5C:
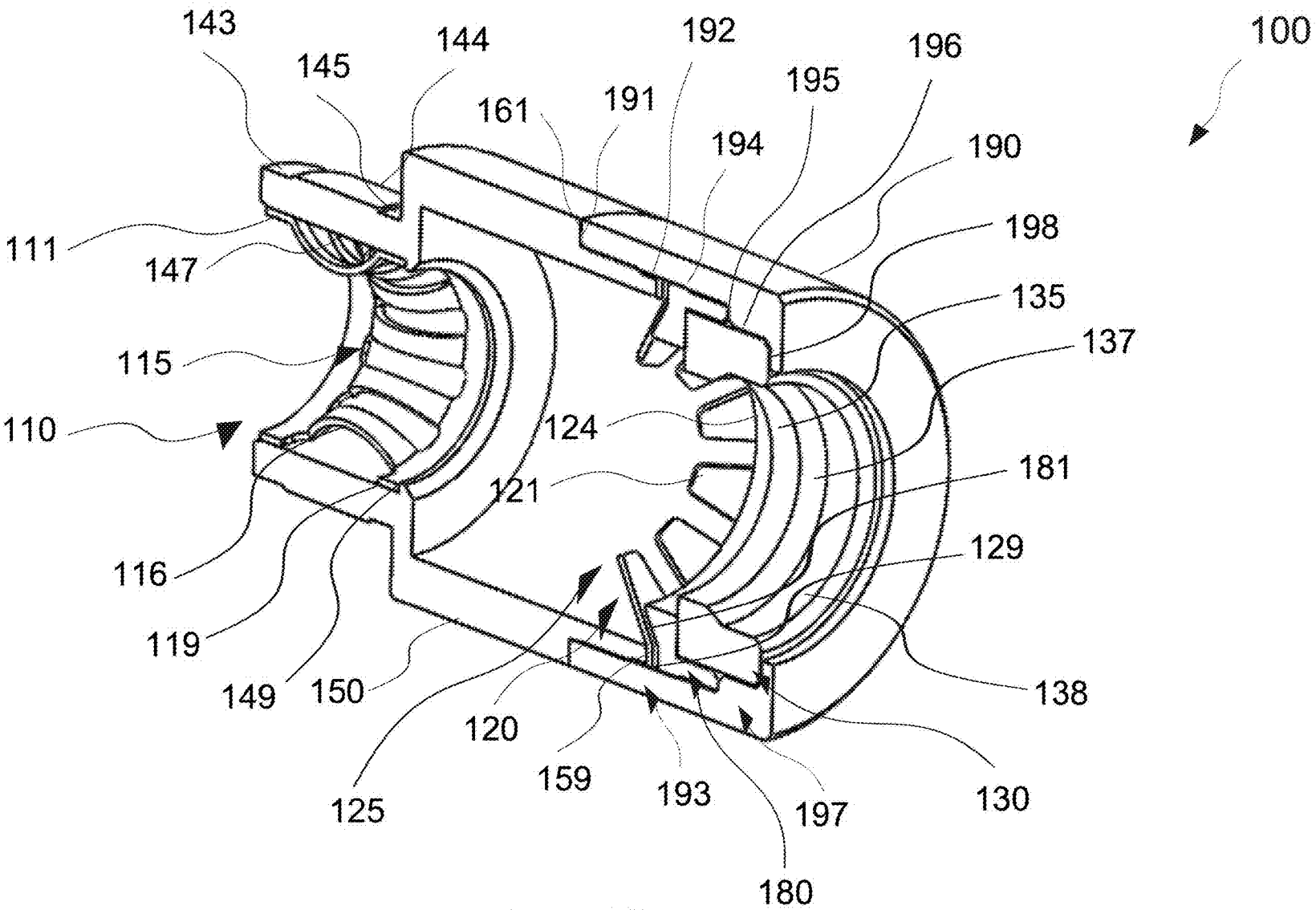
FIG. 5C is a schematic inner half view of the coaxial cable fixing sleeve of FIG. 5A along line A-A in FIG. 5A, according to an example embodiment.
Figure 5D:
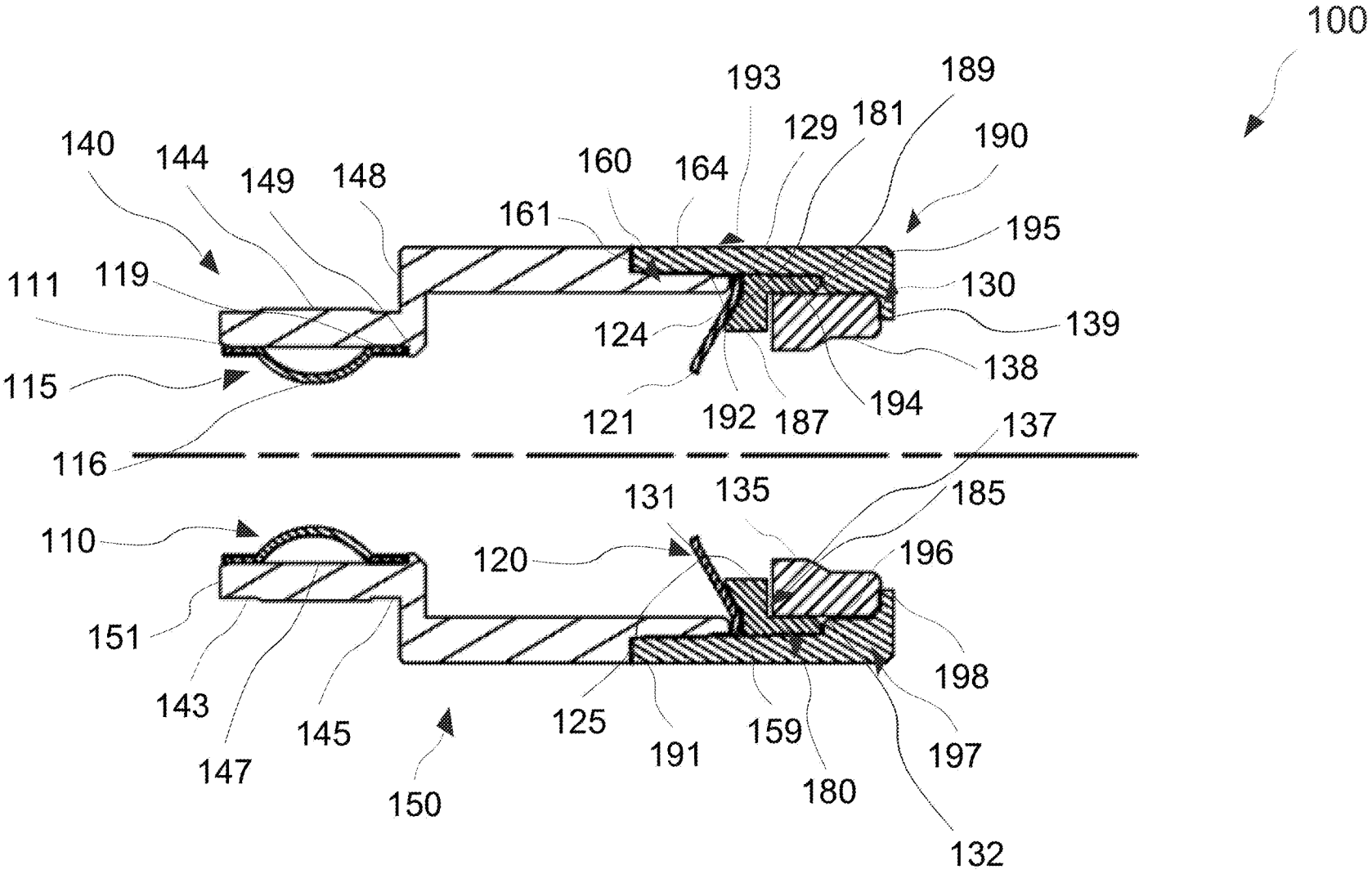
FIG. 5D is a schematic cross-sectional view of the coaxial cable fixing sleeve of FIG. 5A along line A-A in FIG. 5A, according to an example embodiment.

FIG. 5A is a schematic perspective view of the coaxial cable fixing sleeve of FIG. 1, according to an example embodiment. FIG. 5B is a schematic exploded view of the coaxial cable fixing sleeve of FIG. 5A, according to an example embodiment. FIG. 5C is a schematic inner half view of the coaxial cable fixing sleeve of FIG. 5A along line A-A in FIG. 5A, according to an example embodiment. FIG. 5D is a schematic cross-sectional view of the coaxial cable fixing sleeve of FIG. 5A along line A-A in FIG. 5A, according to an example embodiment. Referring to FIGS. 5A to 5D, and referring to FIGS. 1A to 2, in an embodiment, a universal coaxial cable fixing sleeve 100 of a coaxial cable connector system 300 comprises a housing 150, a receiving sleeve 190, a first gripping component 110, a second gripping component 120, a deflecting ring 180, and a third gripping component 130. The housing 150, defining an interior channel therethrough, comprises a first housing portion 140 including a first housing inner surface 147 having a first housing ledge 149 at a distal end thereof, a second housing portion 160 having a second housing outer surface 164 and a second housing stop wall 161 between the second housing outer surface 164 and first housing portion 140, and a housing distal end 159. The receiving sleeve 190, defining an interior channel therethrough, includes a proximal sleeve end 191, a first sleeve portion 193 and a second sleeve portion 197. The first sleeve portion 193 has a first sleeve inner surface 192, a central sleeve inner surface 194, and a central sleeve stop wall 195. The second sleeve portion 197 has a second sleeve inner surface 196 and a second sleeve ledge 198 at a distal end thereof. The central sleeve stop wall 195 is between the proximal sleeve end 191 and the second sleeve ledge 198, whereby when assembled, the proximal sleeve end 191 and first sleeve inner surface 192 rests flush against the second housing stop wall 161 and the second housing outer surface 164, respectively.

The first gripping component 110 is fixedly attached to the first housing inner surface 147 and has one end resting flush against the first housing ledge 149 and the second gripping component 120 has one end fixedly attached to the housing distal end 159 and against the central sleeve inner surface 194. The deflecting ring 180 has a ring inner ramp 181 positioned flush against the second gripping component 120, a ring outer surface 187 fixedly attached to the central sleeve inner surface 194, and a ring distal inner groove 185 opposite the ring inner ramp 181. The third gripping component 130 is fixedly attached within the ring distal inner groove 185, second sleeve inner surface 196, and second sleeve ledge 198.

When the coaxial cable 900 is assembled to the universal coaxial cable fixing sleeve 100, the first gripping component 110 grips a conductive shield 960 of the cable 900, and the second and third gripping components 120, 130 grip a protective outer jacket 990 of the cable 900, respectively. The individual gripping of the conductive shield 960 and protective outer jacket 990 are each, positioned in at least three concentric and evenly separated positions and when the universal coaxial cable fixing sleeve 100 is assembled to a coaxial connector 200, the first housing portion 140 is fixedly engaged to a fixing sleeve receiving portion 260 of the coaxial connector 200.

In some embodiments of the universal coaxial cable fixing sleeve 100, the first housing portion 140 further comprises a first housing proximal end 151, opposite the first housing distal end 159, a first housing outer surface 144, opposite to and encompassing the first housing inner surface 147, having a first housing stop wall 148 between the first housing proximal end 151 and second housing stop wall 161, and a first housing proximal outer surface groove 143 and a first housing distal outer surface groove 145. When the universal coaxial cable fixing sleeve 100 is engaged to a first connector 200 of the coaxial cable connector system 300, protrusions 263, 265 of a fixing sleeve receiving inner surface 267 of a fixing sleeve receiving portion 260 of the first connector 200 correspond to and snap press fit engage into the first housing proximal and first housing distal outer surface grooves 143, 145, respectively, and the first housing proximal end 151 rests flush against a fixing sleeve receiving stop wall 261 of the fixing sleeve receiving portion 260 and a distal fixing sleeve receiving end 209, 409 209 rests flush against a portion of the first housing stop wall 148, and no re-preparation of the cable 900 is required. When the universal coaxial cable fixing sleeve 100 is engaged to a second connector 400 of an another alternative coaxial cable connector system 800, protrusions 463, 465 of a fixing sleeve receiving inner surface 467 of a fixing sleeve receiving portion 460 of the second connector 400 correspond to and snap press fit engage into the first housing proximal and first housing distal outer surface grooves 143, 145, respectively, and the first housing proximal end 151 rests flush against a fixing sleeve receiving stop wall 461 of the fixing sleeve receiving portion 460 and a distal fixing sleeve receiving end 209, 409 409 rests flush against a portion of the first housing stop wall 148, and no re-preparation of the cable 900 is required.

In some embodiments of the universal coaxial cable fixing sleeve 100, the first gripping component 110 comprises a first proximal base 111, a first distal base 119, and a plurality of elastic arches 115. An end of each of the plurality of elastic arches 115 is integrally formed with the first proximal base 111 and an opposite end of each of the plurality of elastic arches 115 is integrally formed with the first distal base 119. An end of the first distal base 119 opposite the plurality of elastic arches 115 rests flush against the first housing ledge 149 and an end of the first proximal base 111 opposite the plurality of elastic arches 115 rests flush with a housing proximal end 151 of the housing 150 opposite the housing distal end 159. Each of the crowns 116 of the plurality of elastic arches 115 is positioned toward a center of the interior channel. When a cable 900 of the coaxial cable connector system 300 is assembled through the first gripping component 110, each of the crowns 116 of the plurality of elastic arches 115 is deformed to grip the conductive shield 960 of the cable 900.

In some embodiments of the universal coaxial cable fixing sleeve 100, the second gripping component 120 comprises a second distal base 129 and a plurality of elastic fingers 125, each plurality of elastic fingers 125 having a finger gripping end 121 and a finger base end 124, wherein a diameter of the finger gripping end 121 is less than a diameter of the finger base end 124. The finger base end 124 is integrally formed with the second distal base 129 and the second distal base 129 is fixedly attached to the housing distal end 159 and against the central sleeve inner surface 194. The ring inner ramp 181 of the deflecting ring 180 is positioned flush against the plurality of elastic fingers 125, facilitating radially inward positioning at an angle of inward incline. When a cable 900 of the coaxial cable connector system 300 is assembled through the second gripping component 120, each of the finger gripping ends 121 of the plurality of elastic fingers 125 are moved radially inward to grip the protective outer jacket 990 of the cable 900, hindering removal of the cable 900.

In some embodiments of the universal coaxial cable fixing sleeve 100, the third gripping component 130 comprises a third gripping proximal end 131, a third gripping distal end 139 opposite the third gripping proximal end 131, an inner flat compression portion 135, an inner flat portion 138, an inner elastic slope 137 between the inner flat compression and inner flat portions 135, 138 and a third gripping outer surface 132 opposite to and encompassing the inner flat compression portion 135, inner flat portion 138 and an inner elastic slope 137. A portion of the third gripping proximal end 131 and third gripping outer surface 132 is fixedly attached within the ring distal inner groove 185 and a portion of the third gripping distal end 139 and third gripping outer surface 132 is fixedly attached to the second sleeve inner surface 196, and second sleeve ledge 198. When a cable 900 of the coaxial cable connector system 300 is assembled through the third gripping component 130, the inner flat compression portion 135 is deformed and compressed to generally a thickness of the inner flat portion 138 to grip the protective outer jacket 990 of the cable 900, hindering removal of the cable 900 and creating a weatherproof seal around the cable 900, preventing humidity, moisture, mildew and dirt from passing therethrough.

In some embodiments, a depth of the second housing stop wall 161 is the same as a thickness of the first sleeve portion 193 and a diameter of the first sleeve inner surface 192 is larger than a diameter of the second housing outer surface 164 for fixed engagement thereto. Also for fixed engagement, a depth of the central sleeve stop wall 195 is the same as a thickness of the housing distal end 159 and a ring distal end 189 formed by the ring distal inner groove 185, a diameter of a ring inner surface 187 of the deflecting ring 180 is larger than a diameter of the inner flat compression portion 135, a thickness of the third gripping distal end 139 is larger than a depth of the second sleeve ledge 198, and a diameter of a second sleeve inner surface 196 is larger than a diameter of the inner flat portion 138.

In some embodiments, the first and second connectors 200, 400 comprise BNC, TNC, SMA, N-Type, F-Type, and MCX and RCA connector types and are not the same. The first housing outer surface 144 is configured to engage within the fixing sleeve receiving inner surfaces 267, 467 of the BNC, TNC, SMA, N-Type, F-Type, and MCX and RCA connector types.

In some embodiments, the amount of the plurality of elastic arches 115 is eleven and the perpendicular distances between the first housing inner surface 147 and the crowns 116 thereof are between 0.2 millimetres and 2.0 millimetres or between 0.3 millimetres and 2.5 millimetres, respectively, and deformation distances of the crowns 116 when a cable 900 of the coaxial cable connector system 300, 500 is assembled through the first gripping component 110 are between 0.1 millimetres and 0.5 millimetres; however the embodiments are not limited thereto. Those of ordinary skill in the relevant art may readily appreciate that other amounts of the plurality of elastic arches 115 and other perpendicular distances between the first housing inner surface 147 and the crowns 116 of the plurality of elastic arches 115 and other deformation distances of the crowns 116 when a cable 900 of the coaxial cable connector system 300, 500 is assembled through the first gripping component 110 may be employed; as long as a cable 900 of the coaxial cable connector system 300 can be assembled through the first gripping component 110 and each of the crowns 116 of the plurality of elastic arches 115 can be deformed to grip the conductive shield 960 of the cable 900.

In some embodiments, the amount of the plurality of elastic fingers 125 is eleven.

In some embodiments, the angle of inward incline of each of the plurality of elastic fingers 125 and ring inner ramp 181 is between 50° degrees to 70° degrees and when a cable 900 of the coaxial cable connector system 300 is assembled thereto, the angle of inward incline of each of the plurality of elastic fingers 125 is further inclined inwardly to between 10° degrees to 30° degrees, facilitating gripping of the protective outer jacket 990 of the cable 900, and hindering removal of the cable 900.

In some embodiments, the shape of the plurality of elastic arches 115 is arch-shaped and the shape of the plurality of elastic fingers 125 is trapezoid-shaped; however, the embodiments are not limited thereto. Those of ordinary skill in the relevant art may readily appreciate that the shape of the plurality of elastic arches 115 and plurality of elastic fingers 125 may be other shapes; as long as a cable 900 of the coaxial cable connector system 300, 500, 800 can be assembled through the first and second gripping components 120, 130 and each of the crowns 116 of the plurality of elastic arches 115 can be deformed to grip the conductive shield 960 of the cable 900 and each of the plurality of elastic fingers 125 may be inclined inwardly to facilitate gripping of the protective outer jacket 990 of the cable 900 and hinder removal of the cable 900.

In some embodiments, the angle of inward incline of the elastic slope 137 of the third gripping component 130 is between 20° degrees to 35° degrees. The angle of inward incline of the elastic slope 137 facilitates deformation and compression of the inner flat compression portion 135 to grip the protective outer jacket 990 of the cable 900.

Figure 6A:
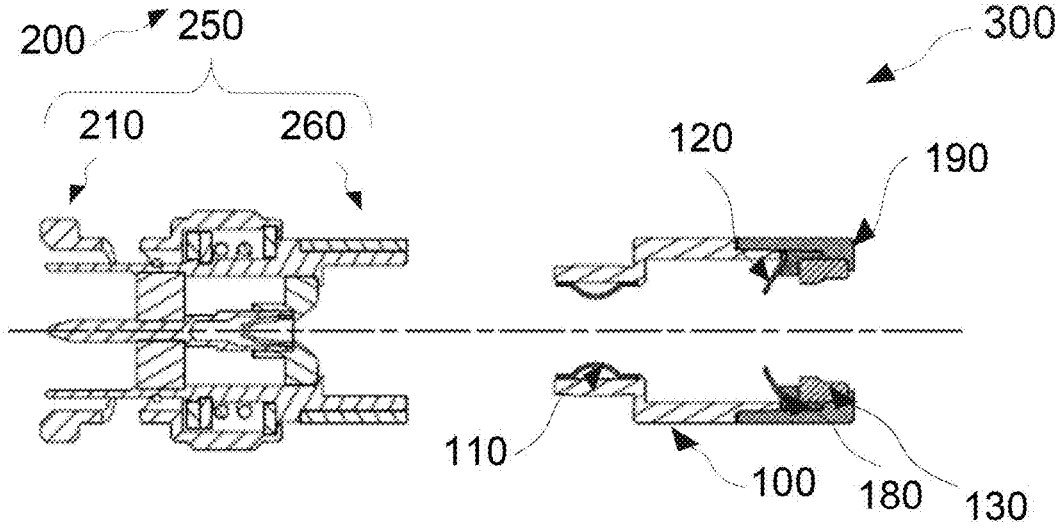
FIG. 6A is a schematic cross-sectional view of the coaxial cable connector and coaxial cable fixing sleeve of FIG. 1A along line A-A in FIG. 1A, according to an example embodiment.
Figure 6B:
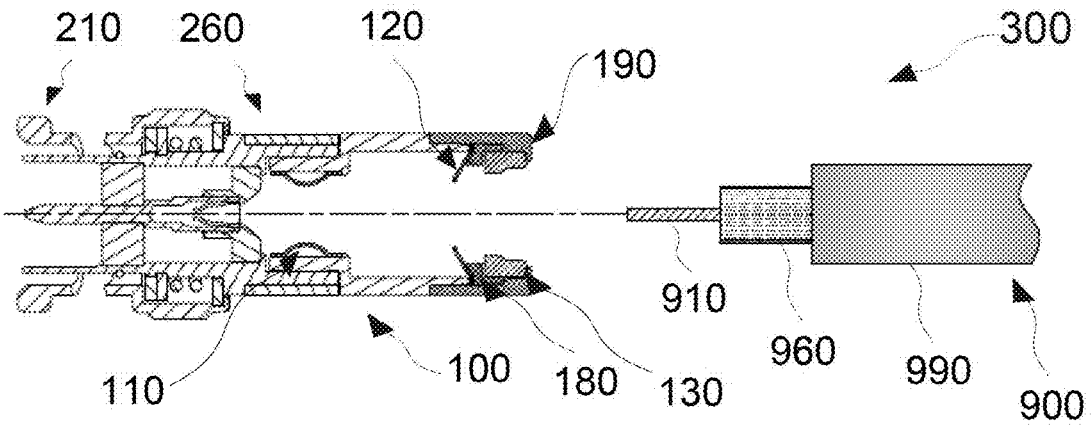
FIG. 6B is a schematic cross-sectional view of the coaxial cable connector system of FIG. 1A along line A-A in FIG. 1A with a disengaged coaxial cable, according to an example embodiment.
Figure 6C:
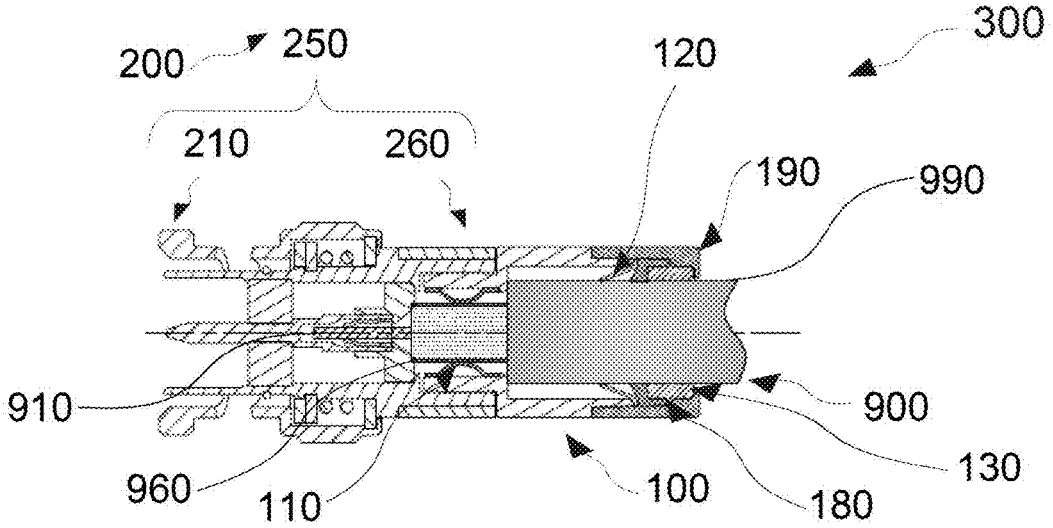
FIG. 6C is a schematic cross-sectional view of a coaxial cable connector system including the coaxial cable connector and coaxial cable of FIG. 1A along line A-A in FIG. 1A with an engaged coaxial cable, according to an example embodiment.
Figure 7A:
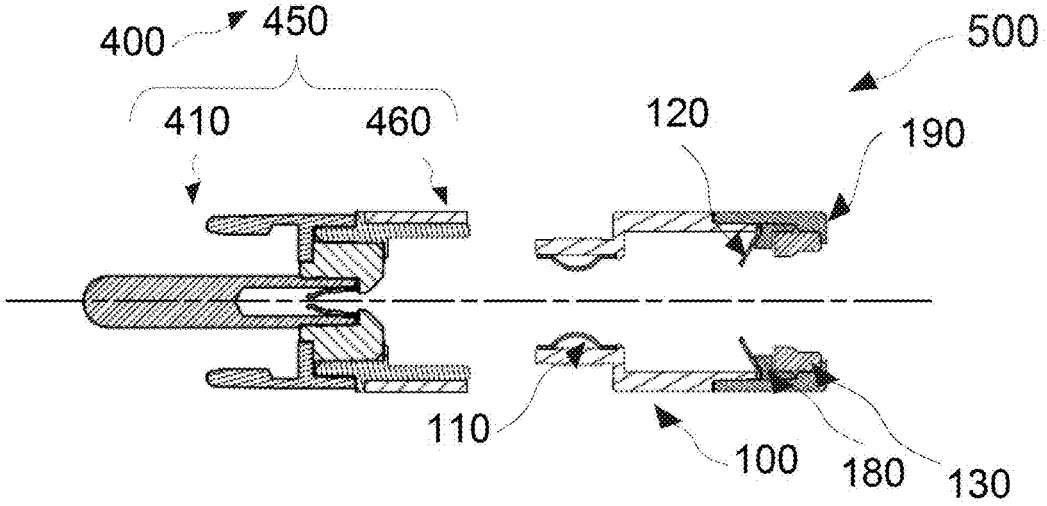
FIG. 7A is a schematic cross-sectional view of the alternative coaxial connector and coaxial cable fixing sleeve of FIG. 3, according to an example embodiment.
Figure 7B:
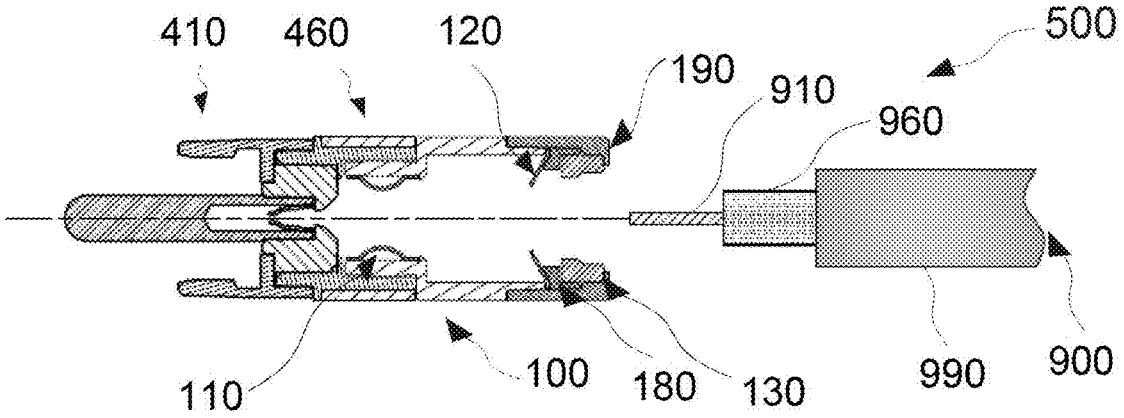
FIG. 7B is a schematic cross-sectional view of the alternative coaxial connector system of FIG. 3 with a disengaged coaxial cable, according to an example embodiment.
Figure 7C:
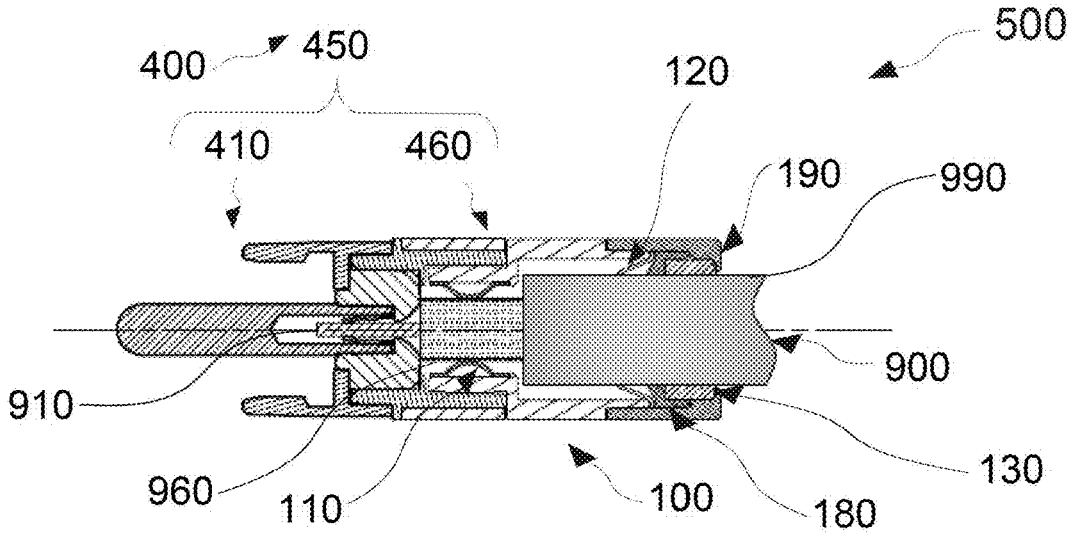
FIG. 7C is a schematic cross-sectional view of the alternative coaxial cable connector system of FIG. 3, according to an example embodiment.

FIG. 6A is a schematic cross-sectional view of the coaxial cable connector and coaxial cable fixing sleeve of FIG. 1A along line A-A in FIG. 1A, according to an example embodiment. FIG. 6B is a schematic cross-sectional view of the coaxial cable connector system of FIG. 1A along line A-A in FIG. 1A with a disengaged coaxial cable, according to an example embodiment. FIG. 6C is a schematic cross-sectional view of a coaxial cable connector system including the coaxial cable connector and coaxial cable of FIG. 1A along line A-A in FIG. 1A with an engaged coaxial cable, according to an example embodiment. FIG. 7A is a schematic cross-sectional view of the alternative coaxial connector and coaxial cable fixing sleeve of FIG. 3, according to an example embodiment. FIG. 7B is a schematic cross-sectional view of the alternative coaxial connector system of FIG. 3 with a disengaged coaxial cable, according to an example embodiment. FIG. 7C is a schematic cross-sectional view of the alternative coaxial cable connector system of FIG. 3, according to an example embodiment. Referring to FIGS. 6A to 7C, and referring to FIGS. 1A to 2 and FIGS. 5A to 5D, in an embodiment, a method of coupling a same cable type to more than one coaxial cable connector type with a single termination is provided. The method comprises preparing a cable 900, assembling the cable 900 to the universal coaxial cable fixing sleeve 100 of the embodiments, determining whether the universal coaxial cable fixing sleeve 100 having the cable 900 is to be coupled to a first connector 200 or a second connector 400. If the universal coaxial cable fixing sleeve 100 having the cable 900 is to be coupled to the first connector 200, the universal coaxial cable fixing sleeve 100 is coupled to the first connector 200, and if the universal coaxial cable fixing sleeve 100 having the cable 900 is to be coupled to the second connector 400, the universal coaxial cable fixing sleeve 100 is coupled to the second connector 400, whereby no re-preparation of the cable 900 is needed.

The embodiments of the method of coupling a same cable type to more than one coaxial cable connector type with a single termination is fast, efficient, and mistake-free. No damage to the cable 900 is incurred during disengagement with the coaxial cable connectors and all that is required is disengagement of the coaxial cable fixing sleeve and engagement to another coaxial cable connector.

In some embodiments, the coaxial cable connectors may be made of brass or stainless-steel based materials having finishes, such as gold, silver, nickel, white bronze, and passivation; however, the embodiments are not limited thereto. Other materials and/or finishes, or any combination thereof, may be employed by those of ordinary skill in the relevant art depending on application by methods known by those skilled in the relevant art, and the embodiments are not limited.

In some embodiments, the universal coaxial cable fixing sleeve may be made of conductive material, such as copper, iron, silver, nickel, tin, gold, a copper-gold alloy, and a copper-tin alloy; however, the embodiments are not limited thereto. Other materials and/or finishes, or any combination thereof may be employed by those of ordinary skill in the relevant art depending on application. As long as RF signals external to the coaxial cable connector may be attenuated, such that the integrity of electrical signals transmitted through the coaxial cable is maintained and the universal coaxial cable fixing sleeve has good hardness to withstand repeated cable fixing cycles with minimal wear and performance deterioration for reliable usage, and the embodiments are not limited.

In some embodiments, the third gripping component of the universal coaxial cable fixing sleeve may be made of an elastic non-conductive material, such as rubber, polymer, or plastic; however the embodiments are not limited thereto. Other materials or any combination thereof may be employed by those of ordinary skill in the relevant art. As long as the third gripping component is elastic and a weatherproof seal is achieved.

With a rise in online and offline connectivity, supporting infrastructural technologies are proliferating in advancement and innovation. Despite, coaxial cables continue to play an important role in different parts of a network infrastructure, such as short reach connections at the server, switch and top or rack layers.

The exploding demand for data volumes and data rates have resulted in existing data centers being upgraded and new data centers begin built. Often, there are multiple cables and cable segments connected in a data center r, with the coaxial cable connector or connector interface type used changing not just once, but, several times during deployment. The problem of poor cable termination, re-termination and/or inadequate minimum straight lengths at each finished cable end during installation has increased.

In the embodiments, coaxial cable connector systems, comprising a coaxial connector, a coaxial cable, and a universal coaxial cable fixing sleeve is provided. The universal coaxial cable fixing sleeve comprises a first gripping component, a second gripping component, and a third gripping component. When the coaxial cable is assembled to the universal coaxial cable fixing sleeve, the first gripping component grips a conductive shield of the cable, and the second and third gripping components grip a protective outer jacket of the cable, respectively. When the universal coaxial cable fixing sleeve is engaged to a first connector, a first housing outer surface thereof corresponds to and fixedly engages with a sleeve receiving inner surface of the first connector, and when disengaged and engaged to a second connector different in type from the first connector, no re-preparation of the cable is required for corresponding fixed engagement.

The embodiments of the universal coaxial cable fixing sleeve provide for a single termination method to be employed for more than one connector interface type, allowing for cabling infrastructure in data centers, as an example, to be even more reliable, easier to install, modular and flexible, to accommodate changes and data center growth. Via the elastic first, second, and third gripping components of the universal coaxial cable fixing sleeve, the application of different amounts of force by an installer for varying thicknesses of a conductive shield and outer diameter of a protective outer jacket due to different manufacturing specifications is not needed for engagement of a prepared cable assembled to the universal coaxial cable fixing sleeve. Meanwhile, when a second type of connector is required to be attached to the same cable type, no re-preparation of the cable is needed. All that is required for attachment of a same cable type to a second type of connector is disengagement and engagement, mitigating poor crimping which may result in uneven impedance matching, signal degradation, damaged equipment or devices, or signals not being transmitted. Thus, time is saved, risk of human error is mitigated, and no special tool is required for completion. Also, via the elastic first, second, and third gripping components, alignment between a metal center pin/cable conductor wire of a connector engaged with the coaxial cable fixing sleeve of the embodiments with a center hole of a plug connector (mating connector) is assured for reliable and accurate transmission of data, video and voice communications via the attached cable. Furthermore, the negative effects on cables having the universal coaxial fixing sleeve due to manipulation of installed and surrounding cables are lessened via the sturdy snap press fit engagement of the universal coaxial cable fixing sleeve to the coaxial cable connector and length and good hardness of the universal coaxial cable fixing sleeve, decreasing the risks of inadequate minimum straight lengths at each installed cable, assuring proper clearance and strain relief and signal continuity and quality. Additionally, via the angle of inward incline of the elastic slope of the third gripping component, deformation and compression of the inner flat compression portion is facilitated to not only grip the protective outer jacket of the cable, but also, hinder removal of the cable and create a weatherproof seal around the cable.

The presently disclosed inventive concepts are not intended to be limited to the embodiments shown herein, but are to be accorded their full scope consistent with the principles underlying the disclosed concepts herein. Directions and references to an element, such as "up," "down,", "upper," "lower," "horizontal," "vertical," "left," "right," and the like, do not imply absolute relationships, positions, and/or orientations. Terms of an element, such as "first" and "second" are not literal, but, distinguishing terms. As used herein, terms "comprises" or "comprising" encompass the notions of "including" and "having" and specify the presence of elements, operations, and/or groups or combinations thereof and do not imply preclusion of the presence or addition of one or more other elements, operations and/or groups or combinations thereof. Sequence of operations do not imply absoluteness unless specifically so stated. Reference to an element in the singular, such as by use of the article "a" or "an", is not intended to mean "one and only one" unless specifically so stated, but rather "one or more". As used herein, "and/or" means "and" or "or", as well as "and" and "or." As used herein, ranges and subranges mean all ranges including whole and/or fractional values therein and language which defines or modifies ranges and subranges, such as "at least," "greater than," "less than," "no more than," and the like, mean subranges and/or an upper or lower limit. All structural and functional equivalents to the elements of the various embodiments described throughout the disclosure that are known or later come to be known to those of ordinary skill in the relevant art are intended to be encompassed by the features described and claimed herein. Moreover, nothing disclosed herein is intended to be dedicated to the public regardless of whether such disclosure may ultimately explicitly be recited in the claims. No element or concept disclosed herein or hereafter presented shall be construed under the provisions of 35 USC 112(f) unless the element or concept is expressly recited using the phrase "means for" or "step for".

In view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in the following claims and any claims presented anytime throughout prosecution of this application or any application claiming benefit of or priority from this application.

What is claimed is:

1. A coaxial cable connector system, comprising:

a coaxial connector comprising a nut, defining an interior channel therethrough, comprising a mating end portion configured to couple with a mating connector and a fixing sleeve receiving portion including a distal fixing sleeve receiving end and a fixing sleeve receiving inner surface having a fixing sleeve receiving stop wall;

a coaxial cable having a center conductor, surrounded by a dielectric core, which is covered by at least a conductive shield and a protective outer jacket; and a universal coaxial cable fixing sleeve comprising:

a housing, defining an interior channel therethrough, comprising a first housing portion including a first housing inner surface, a second housing portion having a second housing outer surface and a second housing stop wall between the first housing portion and second housing outer surface, and a housing distal end;

a receiving sleeve, defining an interior channel therethrough, including a proximal sleeve end, a first sleeve portion having a first sleeve inner surface, a central sleeve inner surface, and a central sleeve stop wall, and a second sleeve portion having a second sleeve inner surface and a second sleeve ledge at a distal end thereof, wherein the central sleeve stop wall is between the proximal sleeve end and second sleeve ledge, whereby when assembled, the proximal sleeve end and first sleeve inner surface rests flush against the second housing stop wall and the second housing outer surface, respectively;

a first gripping component fixedly attached to the first housing inner surface;

a second gripping component having one end fixedly attached to the housing distal end;

a deflecting ring having a ring inner ramp positioned flush against the second gripping component, a ring outer surface fixedly attached to the central sleeve inner surface, and a ring distal inner groove opposite the ring inner ramp; and a third gripping component fixedly attached within the ring distal inner groove, second sleeve inner surface, and second sleeve ledge, whereby when the coaxial cable is assembled to the universal coaxial cable fixing sleeve, the first gripping component grips a conductive shield of the cable, and the second and third gripping components grip the protective outer jacket of the cable, respectively, whereby the individual gripping of the conductive shield and protective outer jacket are each, positioned in at least three concentric and evenly separated positions, and whereby when the universal coaxial cable fixing sleeve is assembled to the coaxial connector, the first housing portion is fixedly engaged to the fixing sleeve receiving portion.

2. The universal coaxial cable fixing sleeve of claim 1, wherein the first housing portion further comprises a first housing outer surface, opposite to and encompassing the first housing inner surface, whereby when the universal coaxial cable fixing sleeve is engaged to a first connector of the coaxial cable connector system, a fixing sleeve receiving inner surface of a fixing sleeve receiving portion of the first connector correspond to and engage with the first housing outer surface, and no re-preparation of the cable is required, and whereby when the universal coaxial cable fixing sleeve is engaged to a second connector of an alternative coaxial cable connector system, a fixing sleeve receiving inner surface of a fixing sleeve receiving portion of the second connector correspond to and engage with the first housing outer surface, and no re-preparation of the cable is required.

3. The universal coaxial cable fixing sleeve of claim 1, wherein the first gripping component comprises a first proximal base, a first distal base, and a plurality of elastic arches, each having crowns, whereby an end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled therethrough, each of the crowns of the plurality of elastic arches is deformed to grip the conductive shield of the cable.

4. The universal coaxial cable fixing sleeve of claim 1, wherein the second gripping component comprises a second distal base and a plurality of elastic fingers, each plurality of elastic fingers having a finger gripping end and a finger base end, wherein a diameter of the finger gripping end is less than a diameter of the finger base end, whereby the finger base end is integrally formed with the second distal base and the second distal base is fixedly attached to the housing distal end, whereby the ring inner ramp of the deflecting ring is positioned flush against the plurality of elastic fingers, facilitating radially inward positioning at an angle of inward incline, and whereby when a cable of the coaxial cable connector system is assembled therethrough, each of the finger gripping ends of the plurality of elastic fingers are moved radially inward to grip the protective outer jacket of the cable, hindering removal of the cable.

5. The universal coaxial cable fixing sleeve of claim 1, wherein the third gripping component comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and inner elastic slope, whereby a portion of the third gripping proximal end and third gripping outer surface is fixedly attached within the ring distal inner groove and a portion of the third gripping distal end and third gripping outer surface is fixedly attached to the second sleeve inner surface, and second sleeve ledge, whereby when a cable of the coaxial cable connector system is assembled therethrough, the inner flat compression portion is deformed and compressed to grip the protective outer jacket of the cable, hindering removal of the cable and creating a weatherproof seal around the cable.

6. The universal coaxial cable fixing sleeve of claim 2, wherein the first and second connectors comprise BNC, TNC, SMA, N-Type, F-Type, and MCX and RCA connector types and are not the same, whereby the first housing outer surface is configured to engage within the fixing sleeve receiving inner surface of the BNC, TNC, SMA, N-Type, F-Type, and MCX and RCA connector types.

7. The universal coaxial cable fixing sleeve of claim 5, wherein an angle of inward incline of the inner elastic slope is between 20° degrees to 35° degrees, facilitating deformation and compression of the inner flat compression portion to grip the protective outer jacket of the cable.

8. A coaxial cable connector system, comprising:

a coaxial cable connector comprising:

a nut, defining an interior channel therethrough, comprising a mating end portion configured to couple with a mating connector, a slidable distal end, and a rotating portion including a first nut inner surface having a nut sliding wall between the slidable distal end and first nut inner surface and a second nut inner surface;

a coaxial cable fixing sleeve comprising:

a main housing, defining an interior channel therethrough, comprising, a main housing proximal portion having a main housing proximal end and a main housing proximal inner surface, and a main housing distal portion having a main housing distal end opposite the main housing proximal end and a main housing outer surface having a main housing stop wall between the main housing distal end and main housing proximal end, whereby the main housing proximal end rests flush against the slidable distal end;

a receiving sleeve, defining an interior channel therethrough, including a proximal sleeve end, a first sleeve portion having a first sleeve inner surface, a central sleeve inner surface, and a central sleeve stop wall, and a second sleeve portion having a second sleeve inner surface and a second sleeve ledge at a distal end thereof, wherein the central sleeve stop wall is between the proximal sleeve end and second sleeve ledge, whereby the proximal sleeve end and first sleeve inner surface rests flush against the main housing stop wall and main housing outer surface, respectively;

a first housing portion, defining an interior channel therethrough, including a first housing outer surface having a first housing outer ring surface and a first housing outer connection surface having a first housing outer stop wall and a first housing inner surface, whereby the first housing outer ring surface and first housing outer surface rests against the first nut inner surface and nut surface, respectively, and whereby the first housing outer connection surface rests flush against the second nut inner surface and main housing proximal inner surface;

a first gripping component fixedly attached to the first housing inner surface;

a second gripping component having one end fixedly attached to the main housing distal end;

a deflecting ring having a ring inner ramp positioned flush against the second gripping component, a ring outer surface fixedly attached to the central sleeve inner surface, and a ring distal inner groove opposite the ring inner ramp; and a third gripping component fixedly attached within the ring distal inner groove, second sleeve inner surface, and second sleeve ledge; and a coaxial cable having a center conductor, surrounded by a dielectric core, which is covered by at least a conductive shield and a protective outer jacket, whereby when the coaxial cable is assembled to the coaxial cable connector, the first gripping component grips a conductive shield of the cable, and the second and third gripping components grip the protective outer jacket of the cable, respectively, whereby the individual gripping of the conductive shield and protective outer jacket are each, positioned in at least three concentric and evenly separated positions.

9. The coaxial cable connector system of claim 8, wherein the first gripping component comprises a first proximal base, a first distal base, and a plurality of elastic arches, each having crowns, whereby an end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled therethrough, each of the crowns of the plurality of elastic arches is deformed to grip the conductive shield of the cable.

10. The coaxial cable connector system of claim 8, wherein the second gripping component comprises a second distal base and a plurality of elastic fingers, each plurality of elastic fingers having a finger gripping end and a finger base end, wherein a diameter of the finger gripping end is less than a diameter of the finger base end, whereby the finger base end is integrally formed with the second distal base and the second distal base is fixedly attached to the housing distal end, whereby the ring inner ramp of the deflecting ring is positioned flush against the plurality of elastic fingers, facilitating radially inward positioning at an angle of inward incline, and whereby when a cable of the coaxial cable connector system is assembled therethrough, each of the finger gripping ends of the plurality of elastic fingers are moved radially inward to grip the protective outer jacket of the cable, hindering removal of the cable.

11. The coaxial cable connector system of claim 8, wherein the third gripping component comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and inner elastic slope, whereby a portion of the third gripping proximal end and third gripping outer surface is fixedly attached within the ring distal inner groove and a portion of the third gripping distal end and third gripping outer surface is fixedly attached to the second sleeve inner surface, and second sleeve ledge, whereby when a cable of the coaxial cable connector system is assembled therethrough, the inner flat compression portion is deformed and compressed to grip the protective outer jacket of the cable, hindering removal of the cable and creating a weatherproof seal around the cable.

12. The coaxial cable connector system of claim 8, wherein the coaxial cable connector is an F-Type connector type.

13. The coaxial cable fixing sleeve of claim 11, wherein an angle of inward incline of the inner elastic slope is between 20° degrees to 35° degrees, facilitating deformation and compression of the inner flat compression portion to grip the protective outer jacket of the cable.

14. A universal coaxial cable fixing sleeve of a coaxial cable connector system, comprising:

a housing, defining an interior channel therethrough, comprising a first housing portion including a first housing inner surface, a second housing portion having a second housing outer surface and a second housing stop wall between the first housing portion and second housing outer surface, and a housing distal end;

a receiving sleeve, defining an interior channel therethrough, including a proximal sleeve end, a first sleeve portion having a first sleeve inner surface, a central sleeve inner surface, and a central sleeve stop wall, and a second sleeve portion having a second sleeve inner surface and a second sleeve ledge at a distal end thereof, wherein the central sleeve stop wall is between the proximal sleeve end and second sleeve ledge, whereby when assembled, the proximal sleeve end and first sleeve inner surface rests flush against the second housing stop wall and the second housing outer surface, respectively;

a first gripping component fixedly attached to the first housing inner surface;

a second gripping component having one end fixedly attached to the housing distal end;

a deflecting ring having a ring inner ramp positioned flush against the second gripping component, a ring outer surface fixedly attached to the central sleeve inner surface, and a ring distal inner groove opposite the ring inner ramp; and a third gripping component fixedly attached within the ring distal inner groove, second sleeve inner surface, and second sleeve ledge, whereby when a cable of the coaxial cable connector system is assembled thereto, the first gripping component grips a conductive shield of the cable, and the second and third gripping components grip a protective outer jacket of the cable, respectively, and whereby the individual gripping of the conductive shield and protective outer jacket are each, positioned in at least three concentric and evenly separated positions of the cable and when the universal coaxial cable fixing sleeve is assembled to a coaxial connector, the first housing portion is fixedly engaged to a fixing sleeve receiving portion of the coaxial connector.

15. The universal coaxial cable fixing sleeve of claim 14, wherein the first housing portion further comprises a first housing outer surface, opposite to and encompassing the first housing inner surface, whereby when the universal coaxial cable fixing sleeve is engaged to a first connector of the coaxial cable connector system, a fixing sleeve receiving inner surface of a fixing sleeve receiving portion of the first connector correspond to and engage with the first housing outer surface, and no re-preparation of the cable is required, and whereby when disengaged from the first connector and engaged to a second connector of an alternative coaxial cable connector system, a fixing sleeve receiving inner surface of a fixing sleeve receiving portion of the second connector correspond to and engage with the first housing outer surface, and no re-preparation of the cable is required.

16. The universal coaxial cable fixing sleeve of claim 14, wherein the first gripping component comprises a first proximal base, a first distal base, and a plurality of elastic arches, each having crowns, whereby an end of each of the plurality of elastic arches is integrally formed with the first proximal base and an opposite end of each of the plurality of elastic arches is integrally formed with the first distal base, whereby each of the crowns of the plurality of elastic arches is positioned toward a center of the interior channel, and whereby when a cable of the coaxial cable connector system is assembled therethrough, each of the crowns of the plurality of elastic arches is deformed to grip the conductive shield of the cable.

17. The universal coaxial cable fixing sleeve of claim 14, wherein the second gripping component comprises a second distal base and a plurality of elastic fingers, each plurality of elastic fingers having a finger gripping end and a finger base end, wherein a diameter of the finger gripping end is less than a diameter of the finger base end, whereby the finger base end is integrally formed with the second distal base and the second distal base is fixedly attached to the housing distal end, whereby the ring inner ramp of the deflecting ring is positioned flush against the plurality of elastic fingers, facilitating radially inward positioning at an angle of inward incline, and whereby when a cable of the coaxial cable connector system is assembled therethrough, each of the finger gripping ends of the plurality of elastic fingers are moved radially inward to grip the protective outer jacket of the cable, hindering removal of the cable.

18. The universal coaxial cable fixing sleeve of claim 14, wherein the third gripping component comprises a third gripping proximal end, a third gripping distal end opposite the third griping proximal end, an inner flat compression portion, an inner flat portion, an inner elastic slope between the inner flat compression and inner flat portions, and a third gripping outer surface opposite to and encompassing the inner flat compression portion, inner flat portion and inner elastic slope, whereby a portion of the third gripping proximal end and third gripping outer surface is fixedly attached within the ring distal inner groove and a portion of the third gripping distal end and third gripping outer surface is fixedly attached to the second sleeve inner surface, and second sleeve ledge, whereby when a cable of the coaxial cable connector system is assembled therethrough, the inner flat compression portion is deformed and compressed to grip the protective outer jacket of the cable, hindering removal of the cable and creating a weatherproof seal around the cable.

19. The universal coaxial cable fixing sleeve of claim 14, wherein the first and second coaxial connectors comprise BNC, TNC, SMA, N-Type, F-Type, and MCX and RCA connector types and are not the same, whereby the first housing outer surface is configured to engage within a sleeve receiving inner surface of the BNC, TNC, SMA, N-Type, F-Type, and MCX and RCA connector types.

20. The universal coaxial cable fixing sleeve of claim 18, wherein an angle of inward incline of the inner elastic slope is between 20° degrees to 35° degrees, facilitating deformation and compression of the inner flat compression portion to grip the protective outer jacket of the cable.

* * * * *